US010672319B2

(12) United States Patent
Kimura et al.

(10) Patent No.: US 10,672,319 B2
(45) Date of Patent: Jun. 2, 2020

(54) DISPLAY DEVICE AND METHOD OF CONVERTING RELATIVE LUMINANCE DATA FOR PICTURE FRAME INTO RELATIVE LUMINANCE DATA FOR DISPLAY PANEL

(71) Applicant: Tianma Japan, Ltd., Kawasaki, Kanagawa (JP)

(72) Inventors: Hiroaki Kimura, Kawasaki (JP); Yojiro Matsueda, Kawasaki (JP)

(73) Assignee: TIANMA JAPAN, LTD., Kawasaki, Kanagawa (JP)

( * ) Notice: Subject to any disclaimer, the term of this patent is extended or adjusted under 35 U.S.C. 154(b) by 0 days.

(21) Appl. No.: 16/262,492

(22) Filed: Jan. 30, 2019

(65) Prior Publication Data

US 2019/0236998 A1 Aug. 1, 2019

(30) Foreign Application Priority Data

Jan. 31, 2018 (JP) ..... 2018-015521
Sep. 25, 2018 (JP) ..... 2018-178685

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2300/0413* (2013.01); *G09G 2300/0426* (2013.01); *G09G 2300/0452* (2013.01); *G09G 2360/16* (2013.01)

(58) Field of Classification Search
CPC ..... G09G 3/2003; G09G 3/3225; G09G 2300/0452; G09G 2300/0426; G09G 2300/0413; G09G 2360/16
See application file for complete search history.

(56) References Cited

U.S. PATENT DOCUMENTS 6,243,055 B1 * 6/2001 Fergason ..... G02B 5/3083 345/32
8,373,727 B2 * 2/2013 Furihata ..... G09G 3/2003 345/690
2003/0174151 A1 9/2003 Awamoto et al.
2006/0170712 A1 * 8/2006 Miller ..... H01L 27/3211 345/695
2017/0053582 A1 * 2/2017 Hsu ..... G06T 5/003
2019/0341002 A1 * 11/2019 Kimura ..... G09G 3/2003

FOREIGN PATENT DOCUMENTS

JP 2003-271088 A 9/2003

* cited by examiner

*Primary Examiner* — Liliana Cerullo
(74) *Attorney, Agent, or Firm* — Sughrue Mion, PLLC

(57) ABSTRACT

Provided is a method of converting relative luminance data of a picture frame into relative luminance data of a display panel. The picture frame includes a region composed of a plurality of frame unit regions arranged in a matrix. The frame unit region is composed of six pixels. The display area of the display panel includes a region composed of a plurality of panel unit areas arranged in a matrix. The panel unit area is composed of twelve sub-pixels arranged in a delta-nabla position. The relative luminance value of each pixel is assigned to one or two subpixels of each of the three color subpixels. The relative luminance value of each sub-pixel is determined from the relative luminance value of the corresponding two adjacent pixels.

16 Claims, 22 Drawing Sheets

DISPLAY DEVICE AND METHOD OF CONVERTING RELATIVE LUMINANCE DATA FOR PICTURE FRAME INTO RELATIVE LUMINANCE DATA FOR DISPLAY PANEL

CROSS-REFERENCE TO RELATED APPLICATIONS

This Non-provisional application claims priority under 35 U.S.C. § 119(a) on Patent Application No. 2018-15521 filed in Japan on Jan. 31, 2018 and Patent Application No. 2018-178685 filed in Japan on Sep. 25, 2018, the entire contents of which are hereby incorporated by reference.

BACKGROUND

This disclosure relates to a display device and a method of converting relative luminance data for a picture frame into relative luminance data for a display panel.

The display region of a color display device is generally composed of red (R) subpixels, green (G) subpixels, and blue (B) subpixels arrayed on the substrate of a display panel. Various arrangements of subpixels (pixel arrangements) have been proposed; for example, RGB stripe arrangement and delta-nabla arrangement (also simply referred to as delta arrangement) have been known (for example, refer to JP 2003-271088 A).

In the RGB stripe arrangement, the boundaries of pixels in a picture frame (data) coincide with the boundaries of subpixels of a display panel; each R subpixel, G subpixel, and B subpixel can be associated with one pixel in a picture frame. In the delta-nabla arrangement, however, the boundaries of pixels in a picture frame do not coincide with the boundaries of subpixels of the display panel. This disagreement could cause degradation in image quality particularly in a display device employing delta-nabla arrangement that virtually increases the resolution by rendering.

SUMMARY

An aspect of this disclosure is a method of converting relative luminance data for a picture frame to relative luminance data for a display panel. The picture frame including a region is composed of a plurality of frame unit regions disposed in a matrix. Each of the plurality of frame unit regions consisting of: a first pixel, a second pixel, and a third pixel disposed in a first direction in order of the first pixel, the second pixel and the third pixel; and a fourth pixel, a fifth pixel, and a sixth pixel disposed in the first direction to be adjacent to the first pixel, the second pixel, and the third pixel, respectively, in a second direction perpendicular to the first direction. A display region of the display panel includes a region composed of a plurality of panel unit regions disposed in a matrix. Each of the plurality of panel unit regions includes: a first subpixel line consisting of a first subpixel of a first color, a first subpixel of a second color, and a first subpixel of a third color disposed in the second direction in order of the first subpixel of the first color, the first subpixel of the second color, and the first subpixel of the third color; a second subpixel line consisting of a second subpixel of the third color, a second subpixel of the first color, and a second subpixel of the second color disposed in the second direction in order of the second subpixel of the third color, the second subpixel of the first color, and the second subpixel of the second color, the second subpixel line being adjacent to the first subpixel line in the first direction; a third subpixel line consisting of a third subpixel of the first color, a third subpixel of the second color, and a third subpixel of the third color disposed in the second direction in order of the third subpixel of the first color, the third subpixel of the second color, and the third subpixel of the third color, the third subpixel line being adjacent to the second subpixel line in the first direction; and a fourth subpixel line consisting of a fourth subpixel of the third color, a fourth subpixel of the first color, and a fourth subpixel of the second color disposed in the second direction in order of the fourth subpixel of the third color, the fourth subpixel of the first color, and the fourth subpixel of the second color, the fourth subpixel line being adjacent to the third subpixel line in the first direction. A first frame unit region is associated with a first panel unit region. The method includes: determining a relative luminance value for the first subpixel of the first color in the first panel unit region from a relative luminance value for the first color of the first pixel in the first frame unit region and a relative luminance value for the first color of the third pixel in a second frame unit region adjacent to the first pixel on the opposite side from the second pixel in the first frame unit region; determining a relative luminance value for the first subpixel of the second color in the first panel unit region from a relative luminance value for the second color of the first pixel in the first frame unit region and a relative luminance value for the second color of the third pixel in the second frame unit region; determining a relative luminance value for the first subpixel of the third color in the first panel unit region from a relative luminance value for the third color of the fourth pixel in the first frame unit region and a relative luminance value for the third color of the sixth pixel in the second frame unit region adjacent to the fourth pixel on the opposite side from the fifth pixel in the first frame unit region; determining a relative luminance value for the second subpixel of the third color in the first panel unit region from a relative luminance value for the third color of the first pixel in the first frame unit region and a relative luminance value for the third color of the second pixel in the first frame unit region; determining a relative luminance value for the second subpixel of the first color in the first panel unit region from a relative luminance value for the first color of the fourth pixel in the first frame unit region and a relative luminance value for the first color of the fifth pixel in the first frame unit region; determining a relative luminance value for the second subpixel of the second color in the first panel unit region from a relative luminance value for the second color of the fourth pixel in the first frame unit region and a relative luminance value for the second color of the fifth pixel in the first frame unit region; determining a relative luminance value for the third subpixel of the first color in the first panel unit region from a relative luminance value for the first color of the second pixel in the first frame unit region and a relative luminance value for the first color of the third pixel in the first frame unit region; determining a relative luminance value for the third subpixel of the second color in the first panel unit region from a relative luminance value for the second color of the second pixel in the first frame unit region and a relative luminance value for the second color of the third pixel in the first frame unit region; determining a relative luminance value for the third subpixel of the third color in the first panel unit region from a relative luminance value for the third color of the fifth pixel in the first frame unit region and a relative luminance value for the third color of the sixth pixel in the first frame unit region; determining a relative luminance value for the fourth subpixel of the third color in the first panel unit region from a relative luminance value for the third color of the second pixel in the first frame unit region and a relative luminance value for the third color of the third pixel in the first frame unit region; determining a relative luminance value for the fourth subpixel of the first color in the first panel unit region from a relative luminance value for the first color of the fifth pixel in the first frame unit region and a relative luminance value for the first color of the sixth pixel in the first frame unit region; and determining a relative luminance value for the fourth subpixel of the second color in the first panel unit region from a relative luminance value for the second color of the fifth pixel in the first frame unit region and a relative luminance value for the second color of the sixth pixel in the first frame unit region.

It is to be understood that both the foregoing general description and the following detailed description are exemplary and explanatory and are not restrictive of this disclosure.

EMBODIMENTS

Figure 1:
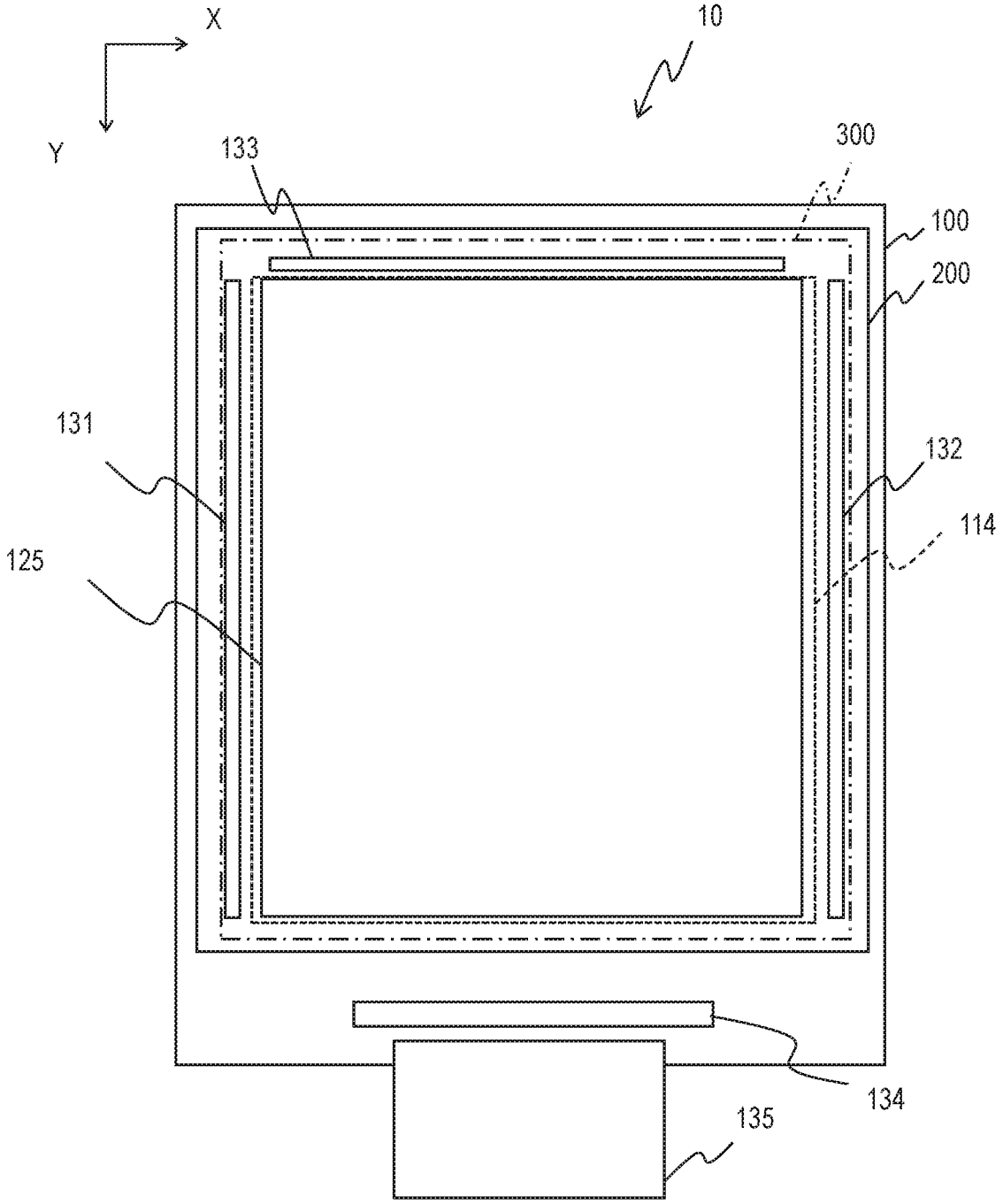
FIG. 1 schematically illustrates a configuration example of an OLED display device in Embodiment 1.

Hereinafter, embodiments of this invention will be described with reference to the accompanying drawings. It should be noted that the embodiments are merely examples to implement this invention and are not to limit the technical scope of this invention. Elements common to the drawings are denoted by the same reference signs.

Embodiment 1

Configuration of Display Device

An overall configuration of a display device in this embodiment is described with reference to FIGS. 1 and 2. The elements in the drawings may be exaggerated in size or shape for clear understanding of the description. In the following, an organic light-emitting diode (OLED) display device is described as an example of the display device; however, the features of this disclosure are applicable to any type of display device other than the OLED display device, such as the liquid crystal display device or the quantum dot display device.

FIG. 1 schematically illustrates a configuration example of an OLED display device 10. The OLED display device 10 includes an OLED display panel and a control device. The OLED display panel includes a thin film transistor (TFT) substrate 100 on which OLED elements are formed, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with dry air and sealed up with the bond 300.

In the periphery of a cathode electrode forming region 114 outer than the display region 125 of the TFT substrate 100, a scanning driver 131, an emission driver 132, a protection circuit 133, and a driver IC 134 are provided. These are connected to the external devices via flexible printed circuits (FPC) 135. The driver IC 134 is included in the control device. The scanning driver 131, the emission driver 132, and the protection circuit 133 are included in the control device or the combination of the OLED display panel and the display device.

The scanning driver 131 drives scanning lines on the TFT substrate 100. The emission driver 132 drives emission control lines to control the light emission periods of subpixels. The protection circuit 133 protects the elements from electrostatic discharge. The driver IC 134 is mounted with an anisotropic conductive film (ACF), for example.

The driver IC 134 provides power and timing signals (control signals) to the scanning driver 131 and the emission driver 132 and further, provides signals corresponding to picture data to the data lines. In other words, the driver IC 134 has a display control function. As will be described later, the driver IC 134 has a function to convert relative luminance data for the pixels of a picture frame into relative luminance data for the subpixels of the display panel.

In FIG. 1, the axis extending from the left to the right is referred to as X-axis and the axis extending from the top to the bottom is referred to as Y-axis. The scanning lines extend along the X-axis. The pixels or subpixels disposed in a line along the X-axis within the display region 125 are referred to as a pixel row or subpixel row; the pixels or subpixels disposed in a line along the Y-axis within the display region 125 are referred to as a pixel column or subpixel column.

Next, a detailed structure of the OLED display device 10 is described. FIG. 2 schematically illustrates a part of a cross-sectional structure of the OLED display device 10. The OLED display device 10 includes a TFT substrate 100 and an encapsulation structural unit opposed to the TFT substrate 100. An example of the encapsulation structural unit is a flexible or inflexible encapsulation substrate 200. The encapsulation structural unit can be a thin film encapsulation (TFE) structure, for example.

The TFT substrate 100 includes a plurality of lower electrodes (for example, anode electrodes 162), one upper electrode (for example, a cathode electrode 166), and a plurality of organic light-emitting layers 165 disposed between an insulating substrate 151 and the encapsulation structural unit. The cathode electrode 166 is a transparent electrode that transmits the light from the organic light-emitting layers 165 (also referred to as organic light-emitting films 165) toward the encapsulation structural unit.

An organic light-emitting layer 165 is disposed between the cathode electrode 166 and an anode electrode 162. The plurality of anode electrodes 162 are disposed on the same plane (for example, on a planarization film 161) and an organic light-emitting layer 165 is disposed on an anode electrode 162.

The OLED display device 10 further includes a plurality of spacers 164 standing toward the encapsulation structural unit and a plurality of circuits each including a plurality of switches. Each of the plurality of circuits is formed between the insulating substrate 151 and an anode electrode 162 and controls the electric current to be supplied to the anode electrode 162.

Figure 2:
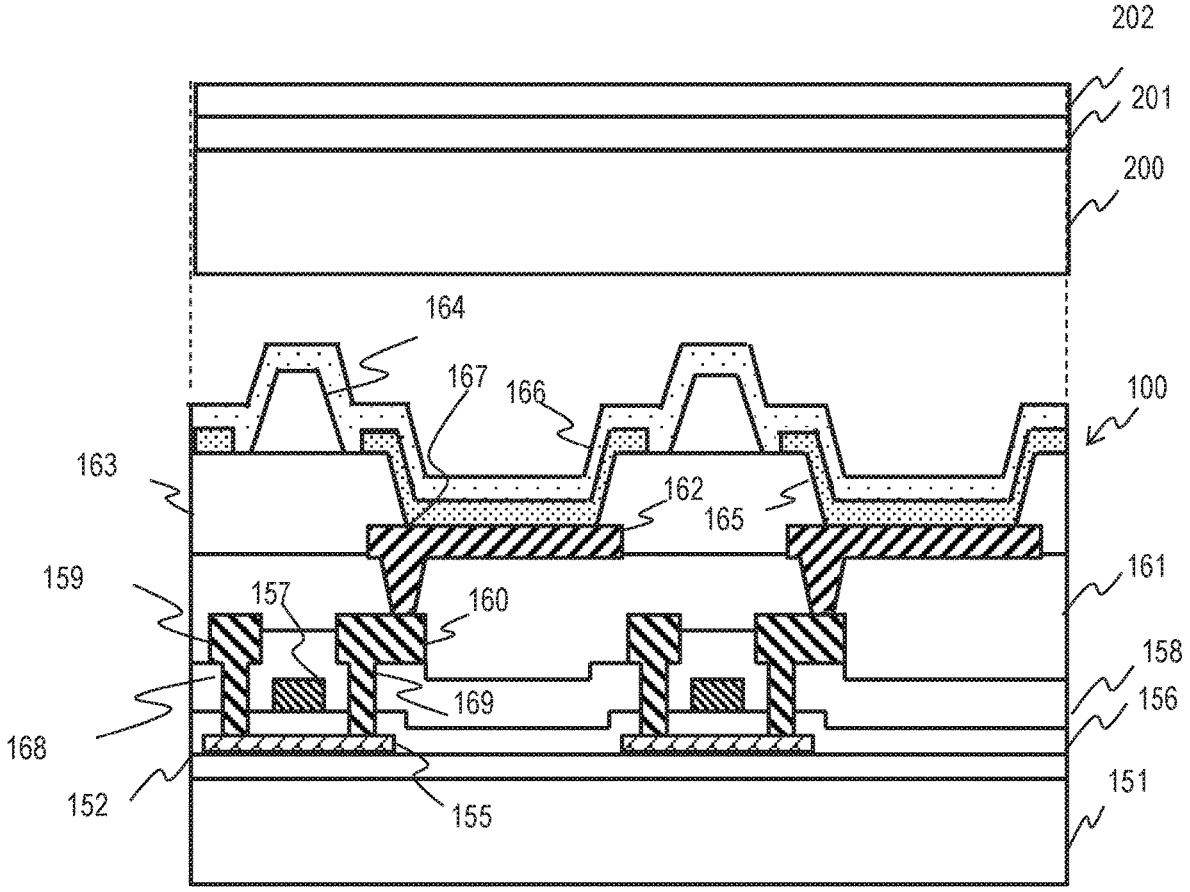
FIG. 2 schematically illustrates a part of a cross-sectional structure of an OLED display device in Embodiment 1.

FIG. 2 illustrates an example of a top-emission pixel structure. The top-emission pixel structure is configured in such a manner that the cathode electrode 166 common to a plurality of pixels is provided on the light emission side (the upper side of the drawing). The cathode electrode 166 has a shape that fully covers the entire display region 125. The features of this disclosure are also applicable to an OLED display device having a bottom-emission pixel structure. The bottom-emission pixel structure has a transparent anode electrode and a reflective cathode electrode to emit light to the external through the TFT substrate 100.

Hereinafter, the OLED display device 10 is described in more detail. The TFT substrate 100 includes subpixels arrayed within the display region 125 and lines provided in the wiring region surrounding the display region 125. The lines connect the pixel circuits with the circuits 131, 132, and 134 provided in the wiring region.

The display region 125 in this embodiment is composed of subpixels arrayed in delta-nabla arrangement. The details of the delta-nabla arrangement will be described later. Hereinafter, the OLED display panel may be referred to as delta-nabla panel. A subpixel is a light emitting region for displaying one of the colors of red (R), green (G), and blue (B). Although the example described in the following displays an image with the combination of these three colors, the OLED display device 10 may display an image with the combination of three colors different from these.

The light emitting region is included in an OLED element which is composed of an anode electrode of a lower electrode, an organic light-emitting layer, and a cathode electrode of an upper electrode. A plurality of OLED elements are formed of one cathode electrode 166, a plurality of anode electrodes 162, and a plurality of organic light-emitting layers 165.

The insulating substrate 151 is made of glass or resin, for example, and is flexible or inflexible. In the following description, the side closer to the insulating substrate 151 is defined as lower side and the side farther from the insulating substrate 151 is defined as upper side. Gate electrodes 157 are provided on a gate insulating film 156. An interlayer insulating film 158 is provided over the gate electrodes 157.

Within the display region 125, source electrodes 159 and drain electrodes 160 are provided above the interlayer insulating film 158. The source electrodes 159 and the drain electrodes 160 are formed of a metal having a high melting point or an alloy of such a metal. Each source electrode 159 and each drain electrode 160 are connected with a channel 155 on an insulating layer 152 through contacts 168 and 169 provided in contact holes of the interlayer insulating film 158.

Over the source electrodes 159 and the drain electrodes 160, an insulative planarization film 161 is provided. Above the insulative planarization film 161, anode electrodes 162 are provided. Each anode electrode 162 is connected with a drain electrode 160 through a contact provided in a contact hole in the planarization film 161. The pixel circuits (TFTs) are formed below the anode electrodes 162.

Above the anode electrodes 162, an insulative pixel defining layer (PDL) 163 is provided to separate OLED elements. An OLED element is composed of an anode electrode 162, an organic light-emitting layer 165, and the cathode electrode 166 (a part thereof) laminated together. The light-emitting region of an OLED element is formed in an opening 167 of the pixel defining layer 163.

Each insulative spacer 164 is provided on the pixel defining layer 163 and between anode electrodes 162. The top face of the spacer 164 is located higher than the top face of the pixel defining layer 163 or closer to the encapsulation substrate 200 and maintains the space between the OLED elements and the encapsulation substrate 200 by supporting the encapsulation substrate 200 when the encapsulation substrate 200 is deformed.

Above each anode electrode 162, an organic light-emitting layer 165 is provided. The organic light-emitting layer 165 is in contact with the pixel defining layer 163 in the opening 167 of the pixel defining layer 163 and its periphery. A cathode electrode 166 is provided over the organic light-emitting layer 165. The cathode electrode 166 is a transparent electrode. The cathode electrode 166 transmits all or part of the visible light from the organic light-emitting layer 165.

The laminated film of the anode electrode 162, the organic light-emitting layer 165, and the cathode electrode 166 formed in an opening 167 of the pixel defining layer 163 corresponds to an OLED element. Electric current flows only within the opening 167 of the pixel defining layer 163 and accordingly, the region of the organic light-emitting layer 165 exposed in the opening 167 is the light emitting region (subpixel) of the OLED element. The cathode electrode 166 is common to the anode electrodes 162 and the organic light-emitting layers 165 (OLED elements) that are formed separately. A not-shown cap layer may be provided over the cathode electrode 166.

The encapsulation substrate 200 is a transparent insulating substrate, which can be made of glass. A $\lambda/4$ plate 201 and a polarizing plate 202 are provided over the light emission surface (top face) of the encapsulation substrate 200 to prevent reflection of light entering from the external.

Configuration of Driver IC

Figure 3:
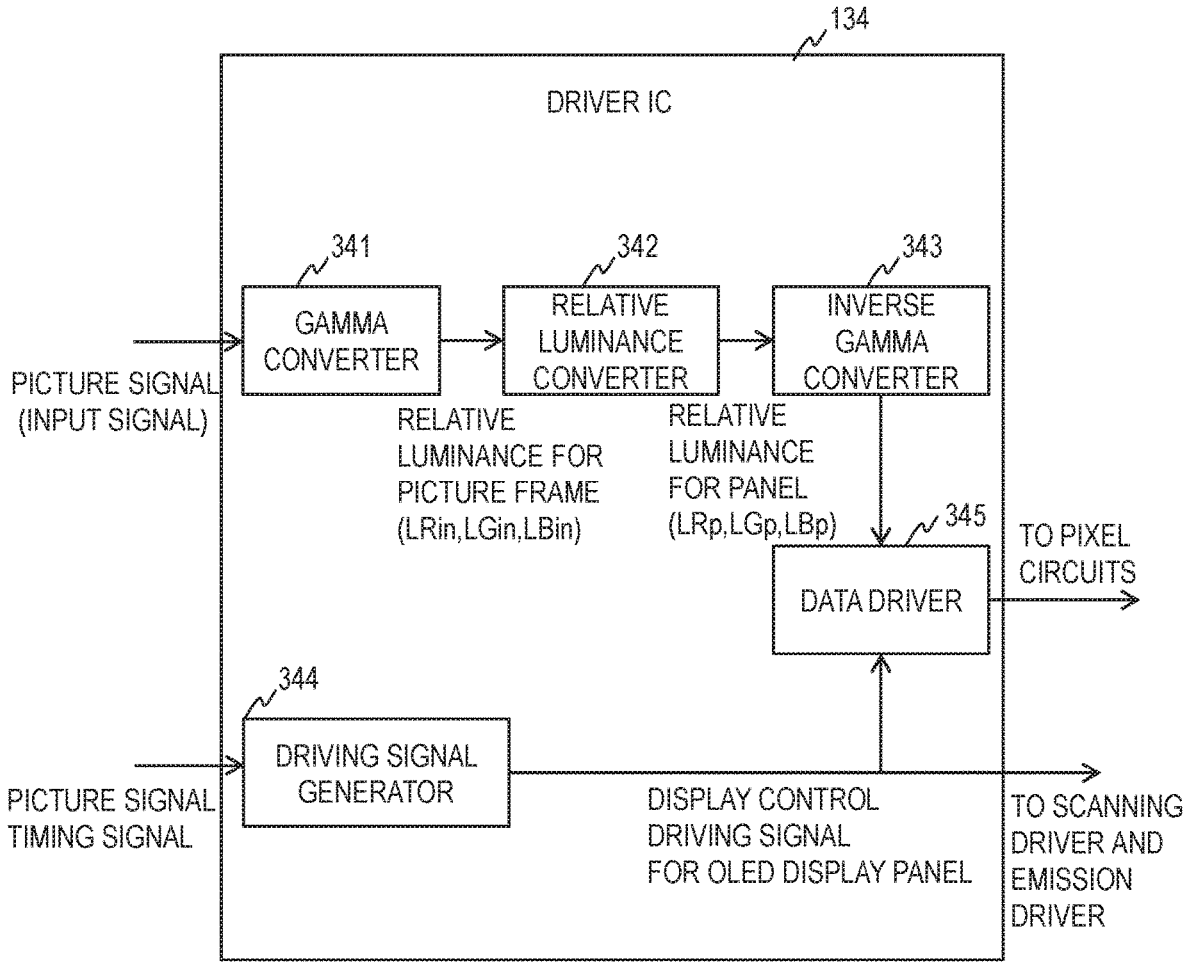
FIG. 3 illustrates logical elements of a driver IC in Embodiment 1.

FIG. 3 illustrates logical elements of the driver IC 134. The driver IC 134 includes a gamma converter 341, a relative luminance converter 342, an inverse gamma converter 343, a driving signal generator 344, and a data driver 345.

The driver IC 134 receives a picture signal and a picture signal timing signal from a not-shown main controller. The picture signal includes data (signal) for successive picture frames. The gamma converter 341 converts the RGB scale values (signal) included in the input picture signal to RGB relative luminance values. More specifically, the gamma converter 341 converts the R scale values, the G scale values, and the B scale values for individual pixels of each picture frame into R relative luminance values (LRin), G relative luminance values (LGin), and B relative luminance values (LBin). The relative luminance values for a pixel are luminance values normalized in the picture frame.

The relative luminance converter 342 converts the R, G, B relative luminance values (LRin, LGin, LBin) for individual pixels of a picture frame into R, G, B relative luminance values (LRp, LGp, LBp) for subpixels of the OLED display panel. The details of the arithmetic processing of the relative luminance converter 342 will be described later. The relative luminance value for a subpixel is a luminance value for the subpixel normalized in the OLED display panel.

The inverse gamma converter 343 converts the relative luminance values for the R subpixels, G subpixels, and B subpixels calculated by the relative luminance converter 342 to scale values for the R subpixels, G subpixels, and B subpixels. The data driver 345 sends a driving signal in accordance with the scale values for the R subpixels, G subpixels, and B subpixels to the pixel circuits.

The driving signal generator 344 converts an input picture signal timing signal to a display control driving signal for the OLED display panel. The picture signal timing signal includes a dot clock (pixel clock) for determining the data transfer rate, a horizontal synchronization signal, a vertical synchronization signal, and a data enable signal.

The driving signal generator 344 converts the frequency of the dot clock of the input picture signal timing signal to ⅔ of the frequency in accordance with the number of pixels in the delta-nabla panel (OLED display panel). As will be described later, the number of pixels in the direction along a scanning line (also referred to as row direction) in the delta-nabla panel in this embodiment is ⅔ of the number of pixels in the direction along the scanning line in the picture frame. This embodiment virtually increases the resolution of the OLED display panel through rendering.

The driving signal generator 344 further generates control signals for the data driver 345, the scanning driver 131, and the emission driver 132 of the delta-nabla panel (or the driving signal for the panel) from the data enable signal, the vertical synchronization signal, and the horizontal synchronization signal and outputs the signals to the drivers.

Pixel Arrangement in Picture Frame and Delta-Nabla Panel

Figure 4:
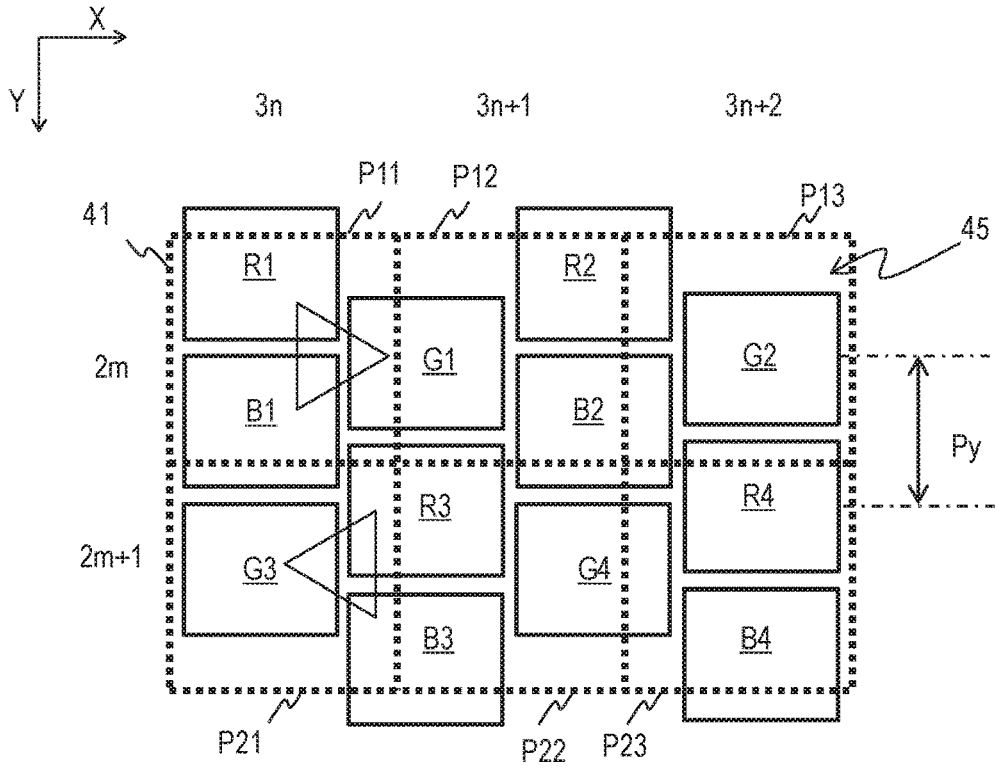
FIG. 4 illustrates a relation between a unit region of a picture frame and a unit region of a delta-nabla panel in Embodiment 1.

FIG. 4 illustrates a relation between a unit region of a picture frame and a unit region of a delta-nabla panel. The image displayed in a picture frame is composed of frame unit regions 41 repeatedly disposed in the row direction (the direction along the X-axis) and the column direction (the direction along the Y-axis). The image is composed of frame unit regions 41 disposed in a matrix. Only a part of the image may be composed of frame unit regions 41.

Each frame unit region 41 consists of six frame pixels (also simply referred to as pixels) P11 to P23 in two rows by three columns. The shapes of the pixels P11 to P23 are identical. The pixels P11 to P23 in this example have square shapes but the shape is not limited to this. The pixels P11 to P23 are disposed in a matrix. The pixels P11, P12, and P13 are disposed side by side in this order in the row direction to be a pixel row (pixel line) extending in the row direction. The pixel P12 is adjacent to the pixels P11 and P13. The centroids of these pixels are located on a virtual straight line extending in the row direction at uniform intervals. The pixels P11, P12, and P13 are included in the 2m-th (m is ½ or a value obtained by adding a positive integer to ½) pixel row in the picture frame.

The pixels P21, P22, and P23 are disposed side by side in this order in the row direction to be a pixel row (pixel line) extending in the row direction. The pixel P22 is adjacent to the pixels P21 and P23. The centroids of these pixels are located on a virtual straight line extending in the row direction at uniform intervals. The pixels P21, P22, and P23 are included in the (2m+1)th pixel row in the picture frame.

The pixels P11 and P21 adjacent to each other are disposed one above the other in the column direction to be a pixel column (pixel line) extending in the column direction. The centroids of these pixels are located on a virtual straight line extending in the column direction at a specific interval. The pixels P11 and P21 are included in the 3n-th (n is ⅓ or a value obtained by adding a positive integer to ⅓) pixel column in the picture frame.

The pixels P12 and P22 adjacent to each other are disposed one above the other in the column direction to be a pixel column (pixel line) extending in the column direction. The centroids of these pixels are located on a virtual straight line extending in the column direction at a specific interval. The pixels P12 and P22 are included in the (3n+1)th pixel column in the picture frame.

The pixels P13 and P23 adjacent to each other are disposed one above the other in the column direction to be a pixel column (pixel line) extending in the column direction. The centroids of these pixels are located on a virtual straight line extending in the column direction at a specific interval. The pixels P13 and P23 are included in the (3n+2)th pixel column in the picture frame.

The display region 125 of the delta-nabla panel is composed of panel unit regions 45 repeatedly disposed in the row direction (the direction along the X-axis) and the column direction (the direction along the Y-axis). The display region 125 is composed of panel unit regions 45 disposed in a matrix. Only a part of the display region 125 may be composed of panel unit regions 45. FIG. 4 includes a frame unit region 41 and a panel unit region 45 corresponding to each other.

Each panel unit region 45 consists of twelve panel subpixels (also simply referred to as subpixels) R1 to R4, G1 to G4, and B1 to B4. The Rs, Gs, and Bs in the reference signs for the subpixels represent red, green, and blue, respectively. The shapes of the subpixels are identical. The subpixels in this example have horizontally long rectangular shapes but the shape of the subpixels is not limited to this. For example, the subpixels can have hexagonal or octagonal shapes; subpixels of different colors can have different shapes.

Defining a panel pixel consisting of an R subpixel, a G subpixel, and a B subpixel adjacent to one another, a panel unit region 45 is composed of panel pixels in two rows by two columns. In FIG. 4, two panel pixels are indicated with a triangle (delta) and an inverted triangle (nabla) by way of example. The delta-nabla arrangement is configured so that delta-shaped panel pixels and nabla-shaped panel pixels are disposed alternately.

The subpixels R1, B1, and G3 are disposed one above the other in this order in the column direction to be a subpixel column (subpixel line) extending in the column direction. The subpixel B1 is adjacent to the subpixels R1 and G3. The centroids of these subpixels are located on a virtual straight line extending in the column direction at uniform intervals. The subpixels G1, R3, and B3 are disposed one above the other in this order in the column direction to be a subpixel column (subpixel line) extending in the column direction. The subpixel R3 is adjacent to the subpixels G1 and B3. The centroids of these subpixels are located on a virtual straight line extending in the column direction at uniform intervals.

The subpixels R2, B2, and G4 are disposed one above the other in this order in the column direction to be a subpixel column (subpixel line) extending in the column direction. The subpixel B2 is adjacent to the subpixels R2 and G4. The centroids of these subpixels are located on a virtual straight line extending in the column direction at uniform intervals. The subpixels G2, R4, and B4 are disposed one above the other in this order in the column direction to be a subpixel column (subpixel line) extending in the column direction. The subpixel R4 is adjacent to the subpixels G2 and B4. The centroids of these subpixels are located on a virtual straight line extending in the column direction at uniform intervals.

In the example of FIG. 4, the order of colors is the same among the subpixel columns; subpixels are disposed cyclically in the order of an R subpixel, a B subpixel, and a G subpixel. Each subpixel in each subpixel column is adjacent to subpixels of the other colors in the adjacent subpixel columns. For example, an R subpixel is adjacent to G subpixels and B subpixels in the adjacent subpixel columns.

In the example of FIG. 4, the layout of subpixels R1 to R4, G1 to G4, and B1 to B4 constituting a panel unit region 45 is a staggered arrangement. The centroid of each subpixel is located between the centroids of two subpixels in each adjacent subpixel column in the column direction and, in the example of FIG. 4, at the middle between the subpixels.

The locations and the colors of the subpixels in the column direction are the same among the odd-numbered pixel columns. In similar, the locations and the colors of the subpixels in the column direction are the same among the even-numbered pixel columns. In the example of FIG. 4, the sub-pixels are disposed at a regular pitch Py in each subpixel column. Each pixel column is different in location with respect to its adjacent pixel columns by (3/2)Py.

The layout of subpixels constituting a panel unit region 45 in FIG. 4 is an example. For example, the layout of subpixels constituting a panel unit region 45 does not need to be a staggered arrangement and can be a matrix arrangement. For example, each subpixel column in a panel unit region 45 can be composed of subpixels of three colors and each subpixel row can be composed of subpixels of two colors disposed alternately. The centroids of the subpixels in a subpixel column do not need to be located on a virtual straight line but the line connecting the centroids can be a bended line. Further, the intervals between the centroids of subpixels in a subpixel column do not need to be uniform.

Figure 5A:
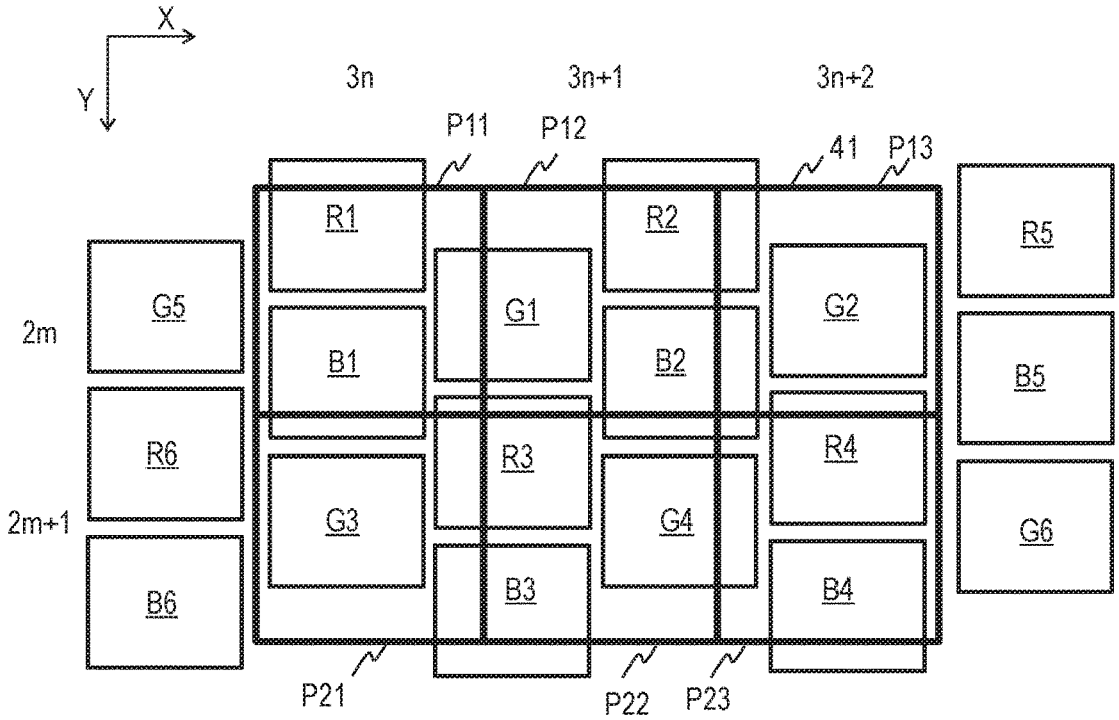
FIG. 5A illustrates a frame unit region and panel subpixels to be assigned the relative luminance values for the frame unit region in Embodiment 1.

FIG. 5A illustrates a frame unit region 41 and panel subpixels to be assigned the relative luminance values for the frame unit region 41. The relative luminance values for the frame unit region 41 are assigned to the corresponding panel unit region 45 and a plurality of subpixels R5, R6, G5, G6, B5, and B6 adjacent to the panel unit region 45 in the row direction. The R relative luminance value, G relative luminance value, and B relative luminance value for one frame pixel are assigned to one or two R subpixels, one or two G subpixels, and one or two B subpixels, respectively.

In assigning the relative luminance values, one pixel row of the frame unit region 41 is associated with one subpixel row in the panel unit region 45. The subpixel row associated with the pixel row consisting of frame pixels P11, P12, and P13 is composed of two subpixels in each odd-numbered subpixel column and one subpixel in each even-numbered subpixel column in the panel unit region 45. Specifically, this subpixel row consists of subpixels R1, B1, G1, R2, B2, and G2.

The subpixel row associated with the pixel row consisting of frame pixels P21, P22, and P23 is composed of one subpixel in each odd-numbered subpixel column and two subpixels in each even-numbered subpixel column in the panel unit region 45. Specifically, this subpixel row consists of subpixels G3, R3, B3, G4, R4, and B4.

As illustrated in FIG. 5A, the relative luminance values for one pixel row in the frame unit region 41 are assigned to one subpixel row in the panel unit region 45 and the subpixels adjacent to the subpixel row in the row direction. Hereinafter, relations between a pixel in a frame unit region 41 and the subpixels to be assigned the relative luminance values for the pixel are described.

Figure 5B:
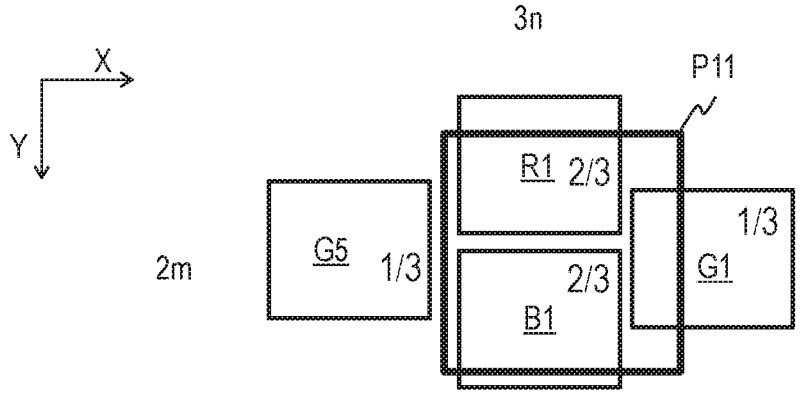
FIG. 5B illustrates a frame pixel and subpixels to be assigned the relative luminance values for the frame pixel in Embodiment 1.

FIG. 5B illustrates the frame pixel P11 and the subpixels to be assigned the relative luminance values for the frame pixel P11. The relative luminance values for the frame pixel P11 are assigned to the subpixels G5, R1, B1, and G1. The subpixel G5 is a subpixel in a panel unit region adjacent to the panel unit region 45 in the row direction and it is adjacent to the subpixels R1 and B1.

The fraction (⅓ or ⅔) in each subpixel represents the rate of the relative luminance value to be assigned to the subpixel with respect to the relative luminance value for the pixel. According to FIG. 5B, ⅔ of the relative luminance value for the red of the frame pixel P11 is assigned to the subpixel R1, ⅔ of the relative luminance value for the blue of the frame pixel P11 is assigned to the subpixel B1, and ⅓ of the relative luminance value for the green of the frame pixel P11 is assigned to each of the subpixels G5 and G1.

Figure 5C:
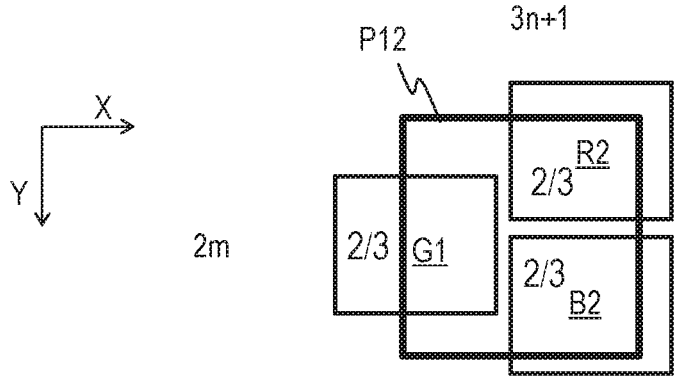
FIG. 5C illustrates a frame pixel and subpixels to be assigned the relative luminance values for the frame pixel in Embodiment 1.

FIG. 5C illustrates the frame pixel P12 and the subpixels to be assigned the relative luminance values for the frame pixel P12. The relative luminance values for the frame pixel P12 are assigned to the subpixels G1, R2, and B2. According to FIG. 5C, ⅔ of the relative luminance value for the red of the frame pixel P12 is assigned to the subpixel R2, ⅔ of the relative luminance value for the blue of the frame pixel P12 is assigned to the subpixel B2, and ⅔ of the relative luminance value for the green of the frame pixel P12 is assigned to the subpixel G1.

Figure 5D:
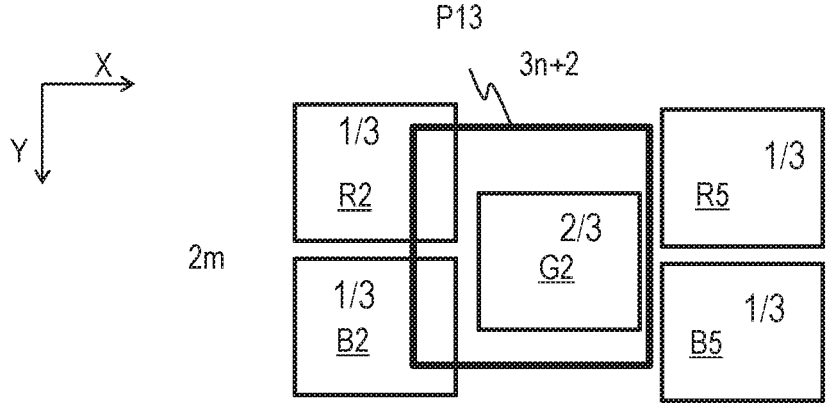
FIG. 5D illustrates a frame pixel and subpixels to be assigned the relative luminance values for the frame pixel in Embodiment 1.

FIG. 5D illustrates the frame pixel P13 and the subpixels to be assigned the relative luminance values for the frame pixel P13. The relative luminance values for the frame pixel P13 are assigned to the subpixels R2, B2, G2, R5, and B5. The subpixels R5 and B5 are subpixels in a panel unit region adjacent to the panel unit region 45 in the row direction and they are adjacent to the subpixel G2.

According to FIG. 5D, ⅓ of the relative luminance value for the red of the frame pixel P13 is assigned to each of the subpixels R2 and R5, ⅓ of the relative luminance value for the blue of the frame pixel P13 is assigned to each of the subpixels B2 and B5, and ⅔ of the relative luminance value for the green of the frame pixel P13 is assigned to the subpixel G2.

Figure 5E:
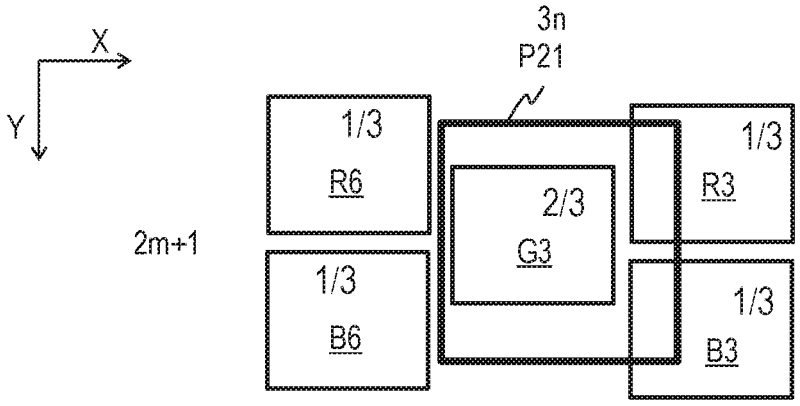
FIG. 5E illustrates a frame pixel and subpixels to be assigned the relative luminance values for the frame pixel in Embodiment 1.

FIG. 5E illustrates the frame pixel P21 and the subpixels to be assigned the relative luminance values for the frame pixel P21. The relative luminance values for the frame pixel P21 are assigned to the subpixels R6, B6, G3, R3, and B3. The subpixels R6 and B6 are subpixels in a panel unit region adjacent to the panel unit region 45 in the row direction and they are adjacent to the subpixel G3.

According to FIG. 5E, ⅓ of the relative luminance value for the red of the frame pixel P21 is assigned to each of the subpixels R6 and R3, ⅓ of the relative luminance value for the blue of the frame pixel P21 is assigned to each of the subpixels B6 and B3, and ⅔ of the relative luminance value for the green of the frame pixel P21 is assigned to the subpixel G3.

Figure 5F:
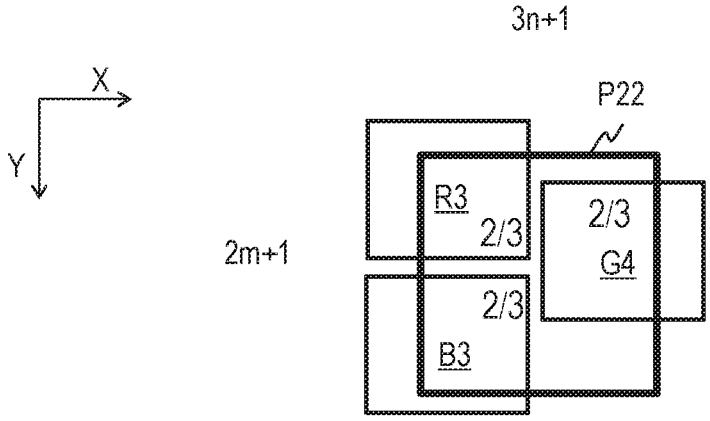
FIG. 5F illustrates a frame pixel and subpixels to be assigned the relative luminance values for the frame pixel in Embodiment 1.

FIG. 5F illustrates the frame pixel P22 and the subpixels to be assigned the relative luminance values for the frame pixel P22. The relative luminance values for the frame pixel P22 are assigned to the subpixels R3, B3, and G4. According to FIG. 5F, ⅔ of the relative luminance value for the red of the frame pixel P22 is assigned to the subpixel R3, ⅔ of the relative luminance value for the blue of the frame pixel P22 is assigned to the subpixel B3, and ⅔ of the relative luminance value for the green of the frame pixel P22 is assigned to the subpixel G4.

Figure 5G:
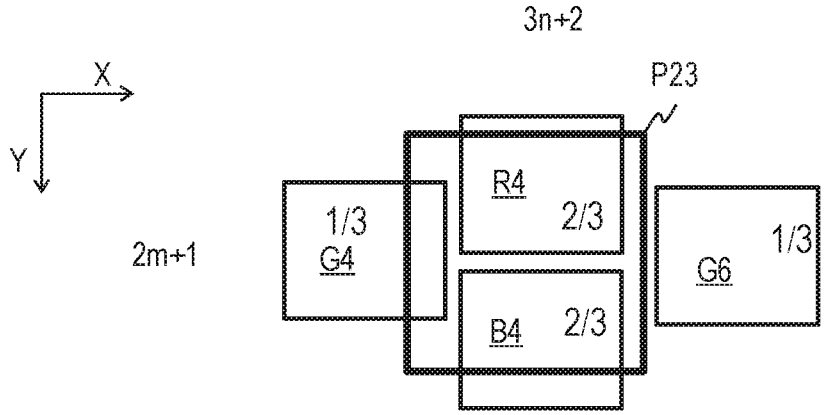
FIG. 5G illustrates a frame pixel and subpixels to be assigned the relative luminance values for the frame pixel in Embodiment 1.

FIG. 5G illustrates the frame pixel P23 and the subpixels to be assigned the relative luminance values for the frame pixel P23. The relative luminance values for the frame pixel P23 are assigned to the subpixels G4, R4, B4, and G6. The subpixel G6 is a subpixel in a panel unit region adjacent to the panel unit region 45 in the row direction and it is adjacent to the subpixels R4 and B4.

According to FIG. 5G, ⅔ of the relative luminance value for the red of the frame pixel P23 is assigned to the subpixel R4, ⅔ of the relative luminance value for the blue of the frame pixel P23 is assigned to the subpixel B4, and ⅓ of the relative luminance value for the green of the frame pixel P23 is assigned to each of the subpixels G4 and G6.

As described with reference to FIGS. 5A to 5G, the relative luminance value for a specific color of one frame pixel is assigned to one or two subpixels of the color. The number of subpixels to be assigned the relative luminance values for one frame pixel is 3, 4, or 5.

The rates (the sums of the rates) of the relative luminance values to be assigned from one frame pixel to three colors, or the rates (the sums of the rates) of the relative luminance values for the red, blue, and green of one frame pixel to be assigned to subpixels of the corresponding colors are the same among the three colors. In this example, the values of the rates are ⅔.

In the case where a relative luminance value for one color is to be assigned to one subpixel, the rate of the relative luminance to be assigned to the subpixel is ⅔. In the case where the relative luminance value for one color is to be assigned to two subpixels, the rate of the relative luminance to be assigned to each subpixel is ⅓. Such assignment of the relative luminance of each frame pixel to the subpixels at the same rate among the colors enables displayed colors to be more consistent with the colors of the picture frame.

The above-described associated relations between a frame pixel and panel subpixels in assigning a relative luminance value can bring the centroid of the plurality of subpixels to be assigned a relative luminance value of a frame pixel close to the centroid of the frame pixel. The centroid of the plurality of subpixels is the coordinates obtained by summing the coordinates of the centroids of the plurality of subpixels. This configuration enables the display to be more consistent with the picture frame.

Figure 6A:
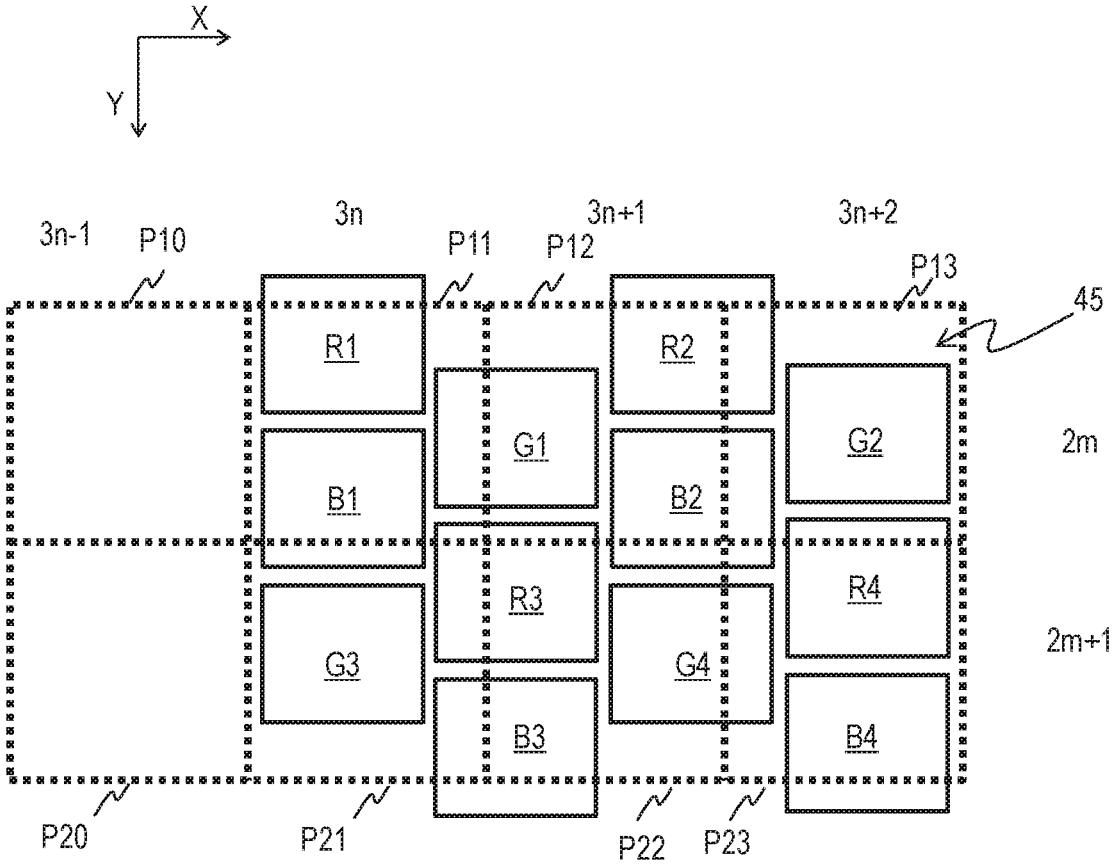
FIG. 6A illustrates a panel unit region and frame pixels from which relative luminance values are assigned to the panel unit region in Embodiment 1.

Next, relative luminance values to be assigned from two frame pixels to subpixel(s) included in a panel unit region 45 are described. FIG. 6A illustrates a panel unit region 45 and frame pixels from which relative luminance values are assigned to the panel unit region 45. A panel unit region 45 is assigned relative luminance values from the corresponding frame unit region 41 and frame pixels in other frame unit regions adjacent to the frame unit region 41 in the row direction.

Figure 6B:
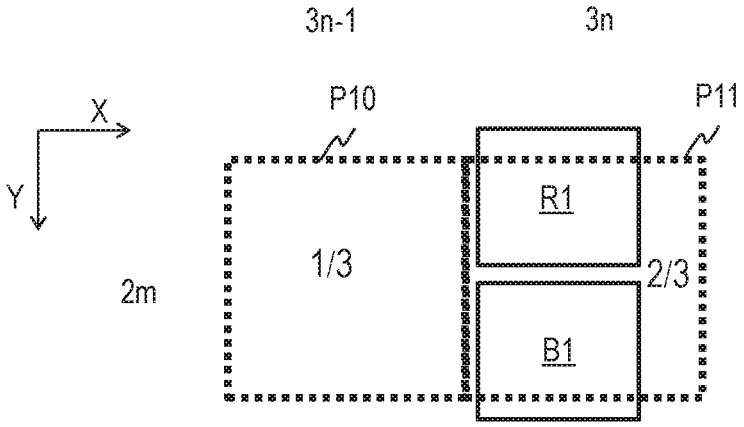
FIG. 6B illustrates subpixels and frame pixels to assign their relative luminance values to the subpixels in Embodiment 1.

FIG. 6B illustrates the subpixels R1 and B1 and the frame pixels to assign their relative luminance values to the subpixels R1 and B1. The subpixel R1 (an example of the first subpixel of the first color) is assigned the relative luminance values for the red of the frame pixel P10 (an example of the third pixel in an adjacent frame unit region) and the frame pixel P11 (an example of the first pixel) adjacent to each other in the row direction. Specifically, the subpixel R1 is assigned ⅓ of the relative luminance value LRin(P10) for the red of the frame pixel P10 and ⅔ of the relative luminance value LRin(P11) for the red of the frame pixel P11. The relative luminance value LR1 for the subpixel R1 is expressed as the following formula:

$$LR1=LR\text{in}(P10)/3+LR\text{in}(P11)*(2/3)$$

The subpixel B1 (an example of the first subpixel of the second color) is assigned relative luminance values for the blue of the frame pixel P10 and the frame pixel P11 adjacent to each other in the row direction. Specifically, the subpixel B1 is assigned ⅓ of the relative luminance value LBin(P10) for the blue of the frame pixel P10 and ⅔ of the relative luminance value LBin(P11) for the blue of the frame pixel P11. The relative luminance value LB1 for the subpixel B1 is expressed as the following formula:

$$LB1=LB\text{in}(P10)/3+LB\text{in}(P11)*(2/3)$$

Figure 6C:
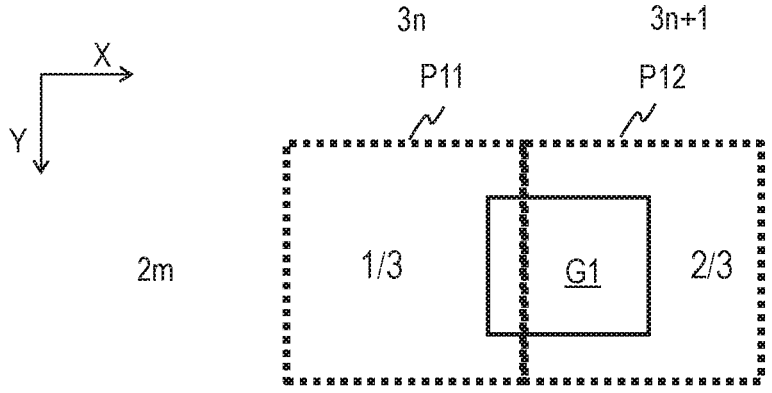
FIG. 6C illustrates a subpixel and frame pixels to assign their relative luminance value to the subpixel in Embodiment 1.

FIG. 6C illustrates the subpixel G1 and the frame pixels to assign their relative luminance values to the subpixel G1. The subpixel G1 (an example of the second subpixel of the third color) is assigned relative luminance values for the green of the frame pixel P11 and the frame pixel P12 (an example of the second pixel) adjacent to each other in the row direction. Specifically, the subpixel G1 is assigned ⅓ of the relative luminance value LGin(P11) for the green of the frame pixel P11 and ⅔ of the relative luminance value LGin(P12) for the green of the frame pixel P12. The relative luminance value LG1 for the subpixel G1 is expressed as the following formula:

$$LG1=LG\text{in}(P11)/3+LG\text{in}(P12)*(2/3)$$

Figure 6D:
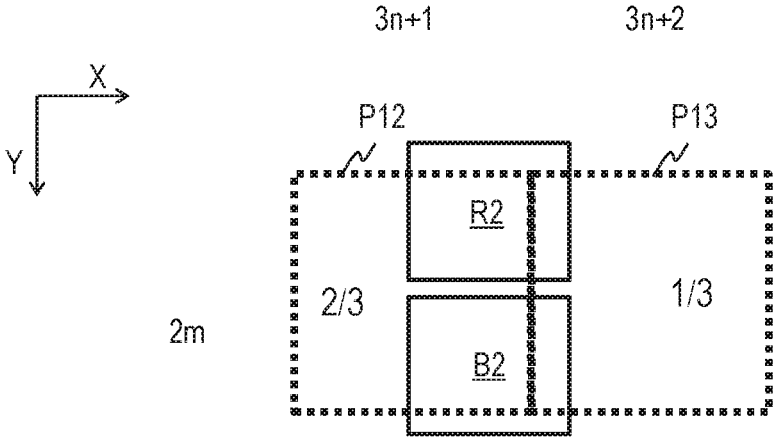
FIG. 6D illustrates subpixels and frame pixels to assign their relative luminance values to the subpixels in Embodiment 1.

FIG. 6D illustrates the subpixels R2 and B2 and the frame pixels to assign their relative luminance values to the subpixels R2 and B2. The subpixel R2 (an example of the third subpixel of the first color) is assigned relative luminance value for the red of the frame pixel P12 and the frame pixel P13 (an example of the third pixel) adjacent to each other in the row direction. Specifically, the subpixel R2 is assigned ⅔ of the relative luminance value LRin(P12) for the red of the frame pixel P12 and ⅓ of the relative luminance value LRin(P13) for the red of the frame pixel P13. The relative luminance value LR2 for the subpixel R2 is expressed as the following formula:

$$LR2=LR\text{in}(P12)*(2/3)+LR\text{in}(P13)/3$$

The subpixel B2 (an example of the third subpixel of the second color) is assigned the relative luminance values for the blue of the frame pixel P12 and the frame pixel P13 adjacent to each other in the row direction. Specifically, the subpixel B2 is assigned ⅔ of the relative luminance value LBin(P12) for the blue of the frame pixel P12 and ⅓ of the relative luminance value LBin(P13) for the blue of the frame pixel P13. The relative luminance value LB2 for the subpixel B2 is expressed as the following formula:

$$LB2=LB\text{in}(P12)*(2/3)+LB\text{in}(P13)/3$$

Figure 6E:
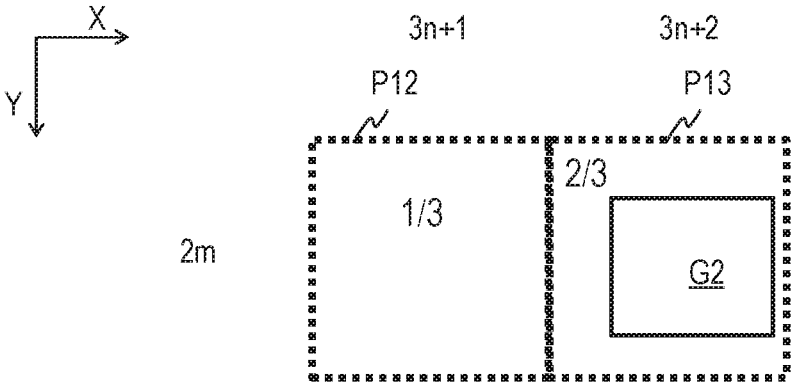
FIG. 6E illustrates a subpixel and frame pixels to assign their relative luminance values to the subpixel in Embodiment 1.

FIG. 6E illustrates the subpixel G2 and the frame pixels to assign their relative luminance values to the subpixel G2. The subpixel G2 (an example of the fourth subpixel of the third color) is assigned the relative luminance values for the green of the frame pixel P12 and the frame pixel P13 adjacent to each other in the row direction. Specifically, the subpixel G2 is assigned ⅓ of the relative luminance value LGin(P12) for the green of the frame pixel P12 and ⅔ of the relative luminance value LGin(P13) for the green of the frame pixel P13. The relative luminance value LG2 for the subpixel G2 is expressed as the following formula:

$$LG2=LG\text{in}(P12)/3+LG\text{in}(P13)*(2/3)$$

Figure 6F:
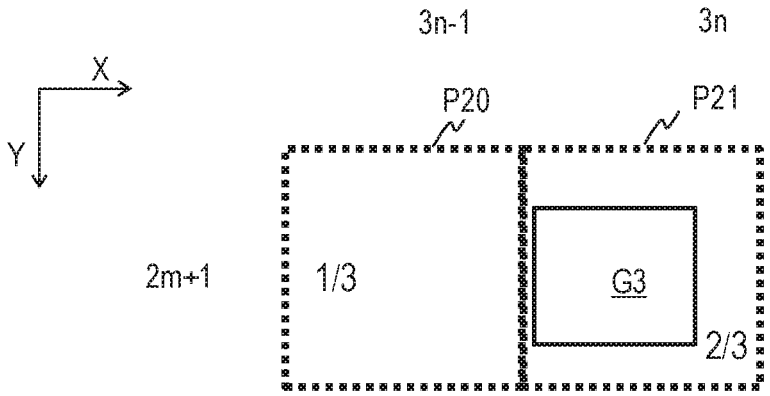
FIG. 6F illustrates a subpixel and frame pixels to assign their relative luminance values to the subpixel in Embodiment 1.

FIG. 6F illustrates the subpixel G3 and the frame pixels to assign their relative luminance values to the subpixel G3. The subpixel G3 (an example of the first subpixel of the third color) is assigned the relative luminance values for the green of the frame pixel P20 (an example of a sixth pixel in an adjacent frame unit region) and the frame pixel P21 (an example of the fourth pixel) adjacent to each other in the row direction. Specifically, the subpixel G3 is assigned ⅓ of the relative luminance value LGin(P20) for the green of the frame pixel P20 and ⅔ of the relative luminance value LGin(P21) for the green of the frame pixel P21. The relative luminance value LG3 for the subpixel G3 is expressed as the following formula:

$$LG3=LG\text{in}(P20)/3+LG\text{in}(P21)*(2/3)$$

Figure 6G:
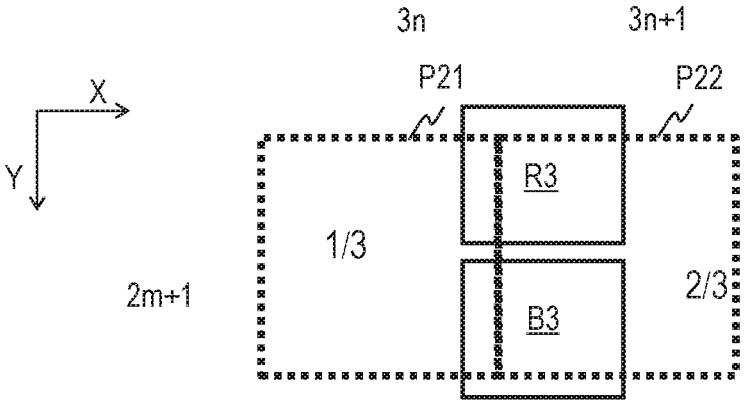
FIG. 6G illustrates subpixels and frame pixels to assign their relative luminance values to the subpixels in Embodiment 1.

FIG. 6G illustrates the subpixels R3 and B3 and the frame pixels to assign their relative luminance values to the subpixels R3 and B3. The subpixel R3 (an example of the second subpixel of the first color) is assigned the relative luminance value for the red of the frame pixel P21 and the frame pixel P22 (an example of the fifth pixel) adjacent to each other in the row direction. Specifically, the subpixel R3 is assigned ⅓ of the relative luminance value LRin(P21) for the red of the frame pixel P21 and ⅔ of the relative luminance value LRin(P22) for the red of the frame pixel P22. The relative luminance value LR3 for the subpixel R3 is expressed as the following formula:

$$LR3=LR\text{in}(P21)/3+LR\text{in}(P22)*(2/3)$$

The subpixel B3 (an example of the second subpixel of the second color) is assigned the relative luminance values for the blue of the frame pixel P21 and the frame pixel P22 adjacent to each other in the row direction. Specifically, the subpixel B3 is assigned ⅓ of the relative luminance value LBin(P21) for the blue of the frame pixel P21 and ⅔ of the relative luminance value LBin(P22) for the blue of the frame pixel P22. The relative luminance value LB3 for the subpixel B3 is expressed as the following formula:

$$LB3=LB\text{in}(P21)/3+LB\text{in}(P22)*(2/3)$$

Figure 6H:
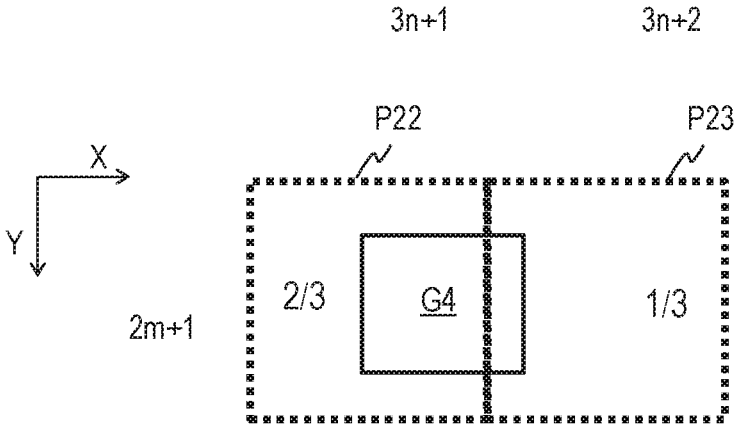
FIG. 6H illustrates a subpixel and frame pixels to assign their relative luminance values to the subpixel in Embodiment 1.

FIG. 6H illustrates the subpixel G4 and the frame pixels to assign their relative luminance values to the subpixel G4. The subpixel G4 (an example of the third subpixel of the third color) is assigned the relative luminance values for the green of the frame pixel P22 and the frame pixel P23 (an example of the sixth pixel) adjacent to each other in the row direction. Specifically, the subpixel G4 is assigned ⅔ of the relative luminance value LGin(P22) for the green of the frame pixel P22 and ⅓ of the relative luminance value LGin(P23) for the green of the frame pixel P23. The relative luminance value LG4 for the subpixel G4 is expressed as the following formula:

$$LG4=LG\text{in}(P22)*(2/3)+LG\text{in}(P23)/3$$

Figure 6I:
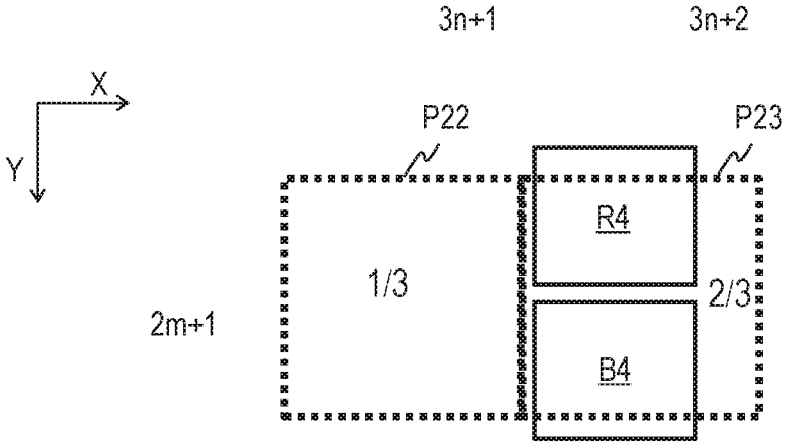
FIG. 6I illustrates subpixels and frame pixels to assign their relative luminance values to the subpixels in Embodiment 1.

FIG. 6I illustrates the subpixels R4 and B4 and the frame pixels to assign their relative luminance values to the subpixels R4 and B4. The subpixel R4 (an example of the fourth subpixel of the first color) is assigned relative luminance value for the red of the frame pixel P22 and the frame pixel P23 adjacent to each other in the row direction. Specifically, the subpixel R4 is assigned ⅓ of the relative luminance value LRin(P22) for the red of the frame pixel P22 and ⅔ of the relative luminance value LRin(P23) for the red of the frame pixel P23. The relative luminance value LR4 for the subpixel R4 is expressed as the following formula:

$$LR4=LR\text{in}(P22)/3+LR\text{in}(P23)*(2/3)$$

The subpixel B4 (an example of the fourth subpixel of the second color) is assigned the relative luminance values for the blue of the frame pixel P22 and the frame pixel P23 adjacent to each other in the row direction. Specifically, the subpixel B4 is assigned ⅓ of the relative luminance value LBin(P22) for the blue of the frame pixel P22 and ⅔ of the relative luminance value LBin(P23) for the blue of the frame pixel P23. The relative luminance value LB4 of the subpixel B4 is expressed as the following formula:

$$LB4=LB\text{in}(P22)/3+LB\text{in}(P23)*(2/3)$$

The relative luminance converter 342 in the driver IC 134 determines the relative luminance values for the individual panel subpixels from the relative luminance values for the associated frame pixels in accordance with the description provided with reference to FIGS. 6A to 6I. As described with reference to FIGS. 6B to 6I, the relative luminance value for each subpixel of a panel unit region is a value obtained by summing the predetermined rates of the relative luminance values for the associated two pixels.

The sums of the rates of relative luminance values to be assigned to individual subpixels (or the sums of the rates predetermined for the associated two pixels) are the same among the subpixels; specifically, they are 1. Since the sums of the rates of relative luminance values assigned to the individual subpixels are the same, colors consistent to the colors of the picture frame can be displayed. Furthermore, since the sum of the rates of the relative luminance values for each subpixel is 1, the dynamic range of the subpixels (the difference between the maximum luminance value and the minimum luminance value) can be utilized maximally.

The sums of the rates of relative luminance values for the individual subpixels can be less than 1. The sums of the rates of the relative luminance values for the individual subpixels can be different as far as the design allows. The rates of the relative luminance values assigned from a frame pixel to subpixels can be different color by color.

Panel Wiring

Figure 7:
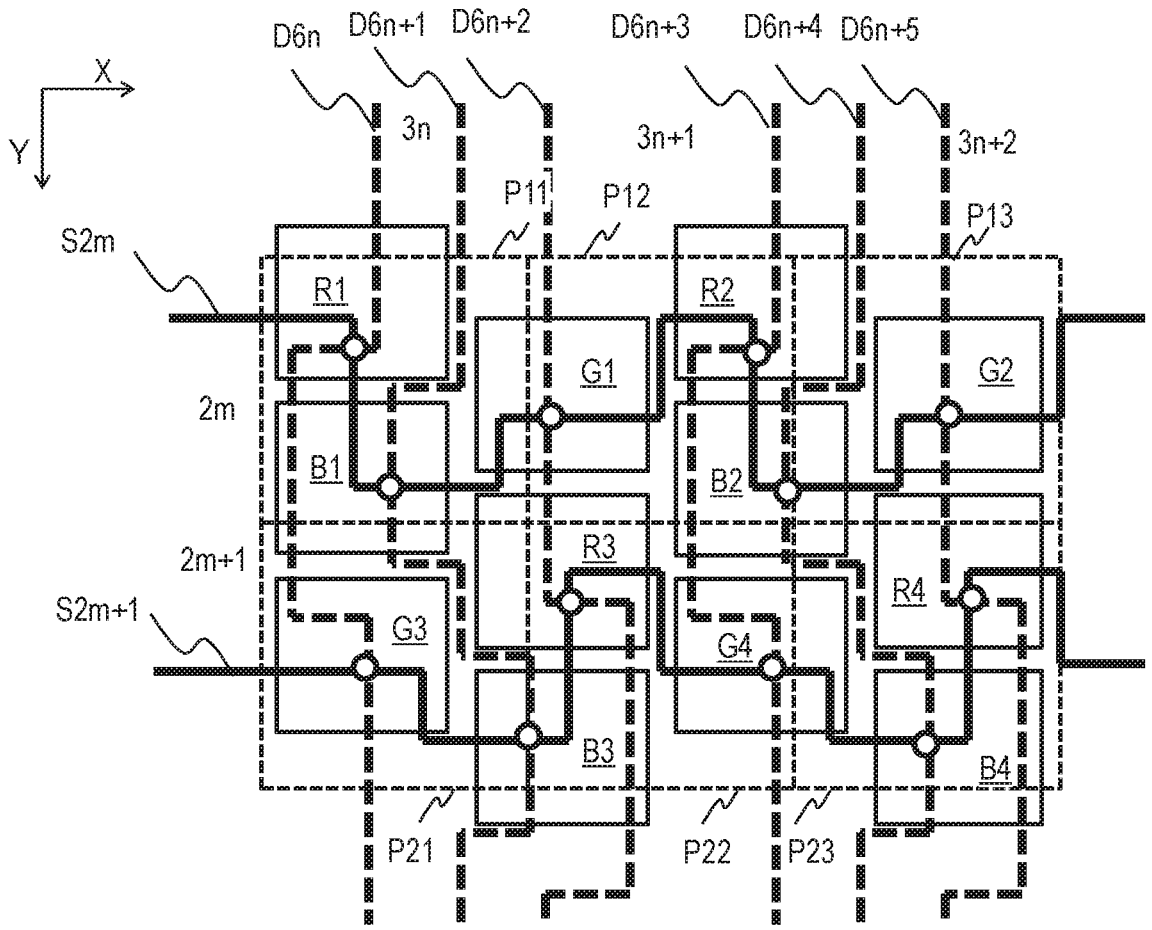
FIG. 7 schematically illustrates connection of subpixels (anode electrodes thereof) and lines in a panel unit region in Embodiment 1.

FIG. 7 schematically illustrates connection of subpixels (anode electrodes thereof) and lines in a panel unit region 45. In FIG. 7, the scanning line and the data line passing through the circle within each subpixel are connected through the pixel circuit for the subpixel to control the subpixel.

All subpixels to be assigned relative luminance values from one pixel row in the frame unit region 41 are connected with the same scanning line. Specifically, the panel subpixels R1, B1, G1, R2, B2, and G2 are connected with a scanning line S2*m*. The panel subpixels R3, B3, G3, R4, B4, and G4 are connected with a scanning line S2*m*+1.

The panel subpixels R1, B1, G1, R2, B2, and G2 are assigned relative luminance values only from the 2m-th frame pixel row in the picture frame. The panel subpixels R3, B3, G3, R4, B4, and G4 are assigned relative luminance values only from the (2m+1)th frame pixel row in the picture frame.

In the display region 125, all panel subpixels associated with one frame pixel row are connected with the same scanning line. The relative luminance value for a panel subpixel is determined only from the relative luminance values for frame pixels in one frame pixel row and does not rely on the relative luminance values for the other frame pixel rows. Accordingly, a line memory for storing relative luminance values for other frame pixel rows is not necessary to calculate the signal to be provided to the subpixel through a data line.

In the example of FIG. 7, the subpixels connected with one scanning line are connected with different data lines. Specifically, the panel subpixels R1 and G3 are connected with a data line D6*n*. The panel subpixels B1 and B3 are connected with a data line D6*n*+1. The panel subpixels G1 and R3 are connected with a data line D6*n*+2. The panel subpixels R2 and G4 are connected with a data line D6*n*+3. The panel subpixels B2 and B4 are connected with a data line D6*n*+4. The panel subpixels G2 and R4 are connected with a data line D6*n*+5.

The connection of the subpixels and the lines illustrated in FIG. 7 is an example and other connection is available. For example, a plurality of subpixels connected with one scanning line can be connected with one data line.

To avoid degradation in display quality between a picture frame and a display panel that are different in number of pixels, this embodiment converts relative luminance values for a frame pixel to relative luminance values for panel subpixels with simple calculations (circuit configuration).

Embodiment 2

Figure 8:
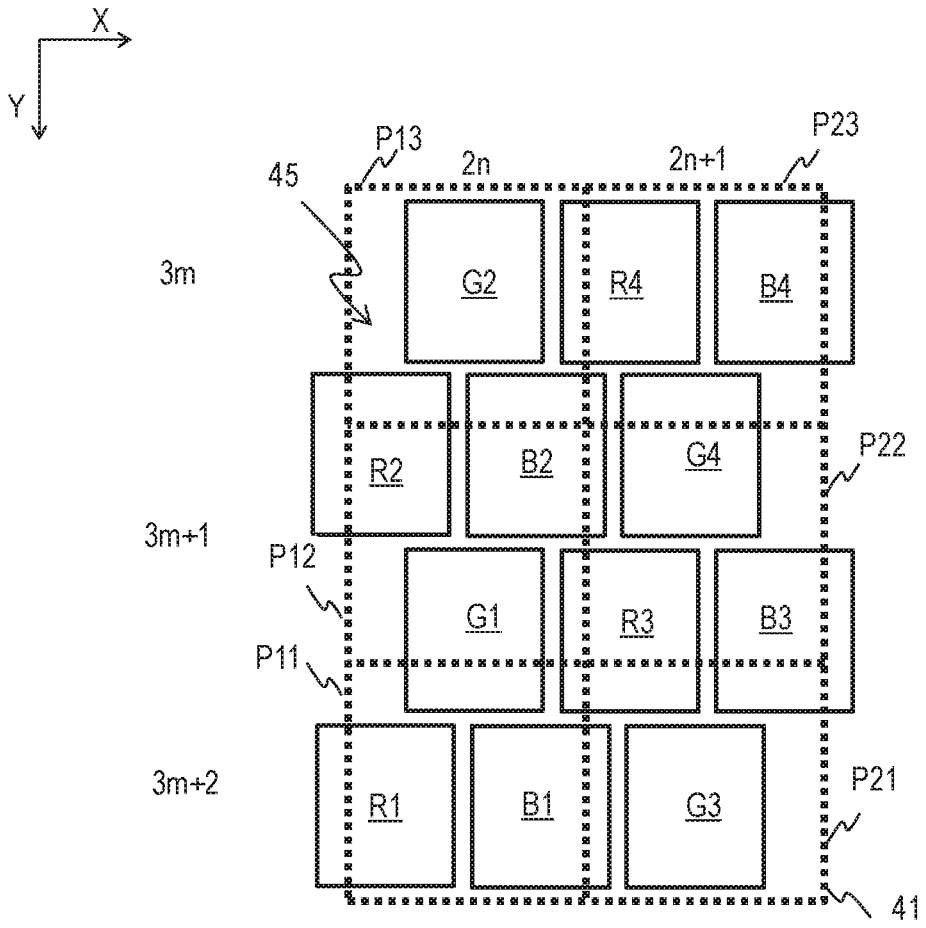
FIG. 8 illustrates a relation between a unit region of a picture frame and a unit region of a delta-nabla panel in Embodiment 2.

Hereinafter, another example of pixel arrangement in a picture frame and a delta-nabla panel is described. Differences from Embodiment 1 are mainly described in the following. FIG. 8 illustrates a relation between a unit region of a picture frame and a unit region of a delta-nabla panel. The configurations of the frame unit region 41 and the panel unit region 45 in FIG. 8 are obtained by rotating the configuration in FIG. 4 anticlockwise by 90°. In other words, the rows and the columns in the configuration in Embodiment 1 are replaced with each other.

For convenience of explanation of this embodiment, the frame pixels constituting a frame unit region 41 are assigned the same reference signs as those for the corresponding frame pixels in Embodiment 1. In similar, the panel subpixels constituting a panel unit region 45 are assigned the same reference signs as those for the corresponding panel subpixels in Embodiment 1. The same applies to the frame pixels in other frame unit regions adjacent to the frame unit region 41 and the panel subpixels adjacent to the panel unit region 45.

Each frame unit region 41 consists of six frame pixels in three rows by two columns. The pixels P11, P12, and P13 are disposed one above the other in this order in the column direction to be a pixel column (pixel line) extending in the column direction. The pixel P12 is adjacent to the pixels P11 and P13. The centroids of these pixels are located on a virtual straight line extending in the column direction at uniform intervals. The pixels P11, P12, and P13 are included in the 2n-th pixel column in the picture frame.

The pixels P21, P22, and P23 are disposed one above the other in this order in the column direction to be a pixel column (pixel line) extending in the column direction. The pixel P22 is adjacent to the pixels P21 and P23. The centroids of these pixels are located on a virtual straight line extending in the column direction at uniform intervals. The pixels P21, P22, and P23 are included in the (2n+1)th pixel column in the picture frame.

The pixels P11 and P21 adjacent to each other are disposed side by side in the row direction to be a pixel row (pixel line) extending in the row direction. The centroids of these pixels are located on a virtual straight line extending in the row direction at a specific interval. The pixels P11 and P21 are included in the (3m+2)th pixel row in the picture frame.

The pixels P12 and P22 adjacent to each other are disposed side by side in the row direction to be a pixel row (pixel line) extending in the row direction. The centroids of these pixels are located on a virtual straight line extending in the row direction at a specific interval. The pixels P12 and P22 are included in the (3m+1)th pixel row in the picture frame.

The pixels P13 and P23 adjacent to each other are disposed side by side in the row direction to be a pixel row (pixel line) extending in the row direction. The centroids of these pixels are located on a virtual straight line extending in the row direction at a specific interval. The pixels P13 and P23 are included in the 3m-th pixel row in the picture frame.

Each panel unit region 45 consists of twelve panel subpixels R1 to R4, G1 to G4, and B1 to B4. The subpixels in this example have vertically long rectangular shapes but the shape of the subpixels is not limited to this. The subpixels R1, B1, and G3 are disposed side by side in this order in the row direction to be a subpixel row (subpixel line) extending in the row direction. The subpixel B1 is adjacent to the subpixels R1 and G3. The centroids of these subpixels are located on a virtual straight line extending in the row direction at uniform intervals.

The subpixels G1, R3, and B3 are disposed side by side in this order in the row direction to be a subpixel row (subpixel line) extending in the row direction. The subpixel R3 is adjacent to the subpixels G1 and B3. The centroids of these subpixels are located on a virtual straight line extending in the row direction at uniform intervals.

The subpixels R2, B2, and G4 are disposed side by side in this order in the row direction to be a subpixel row (subpixel line) extending in the row direction. The subpixel B2 is adjacent to the subpixels R2 and G4. The centroids of these subpixels are located on a virtual straight line extending in the row direction at uniform intervals. The subpixels G2, R4, and B4 are disposed side by side in this order in the row direction to be a subpixel row (subpixel line) extending in the row direction. The subpixel R4 is adjacent to the subpixels G2 and B4. The centroids of these subpixels are located on a virtual straight line extending in the row direction at uniform intervals.

In the example of FIG. 8, the order of colors is the same among the subpixel rows; subpixels are disposed cyclically in the order of an R subpixel, a B subpixel, and a G subpixel. Each subpixel in each subpixel row is adjacent to subpixels of the other colors in the adjacent subpixel rows. For example, an R subpixel is adjacent to G subpixels and B subpixels in the adjacent subpixel rows.

In the example of FIG. 8, the layout of subpixels R1 to R4, G1 to G4, and B1 to B4 constituting a panel unit region 45 is a staggered arrangement. The centroid of each subpixel is located between the centroids of two subpixels in each adjacent subpixel row in the row direction and, in the example of FIG. 8, at the middle between the subpixels.

The locations and the colors of the subpixels in the row direction are the same among the odd-numbered pixel rows. In similar, the locations and the colors of the subpixels in the row direction are the same among the even-numbered pixel rows. In the example of FIG. 8, the sub-pixels are disposed at a regular pitch in each subpixel row. Each subpixel row is different in location with respect to its adjacent pixel row by 3/2 pitch.

The layout of subpixels constituting a panel unit region 45 in FIG. 8 is an example. For example, the layout of subpixels constituting a panel unit region 45 does not need to be a staggered arrangement and can be a matrix arrangement. For example, the subpixel rows in a panel unit region 45 can be composed of subpixels of three colors and each subpixel column can be composed of subpixels of two colors disposed alternately. The centroids of the subpixels in a subpixel row do not need to be located on a virtual straight line but the line connecting the centroids can be a bended line. Further, the intervals between the centroids of subpixels in a subpixel row do not need to be uniform.

Figure 9A:
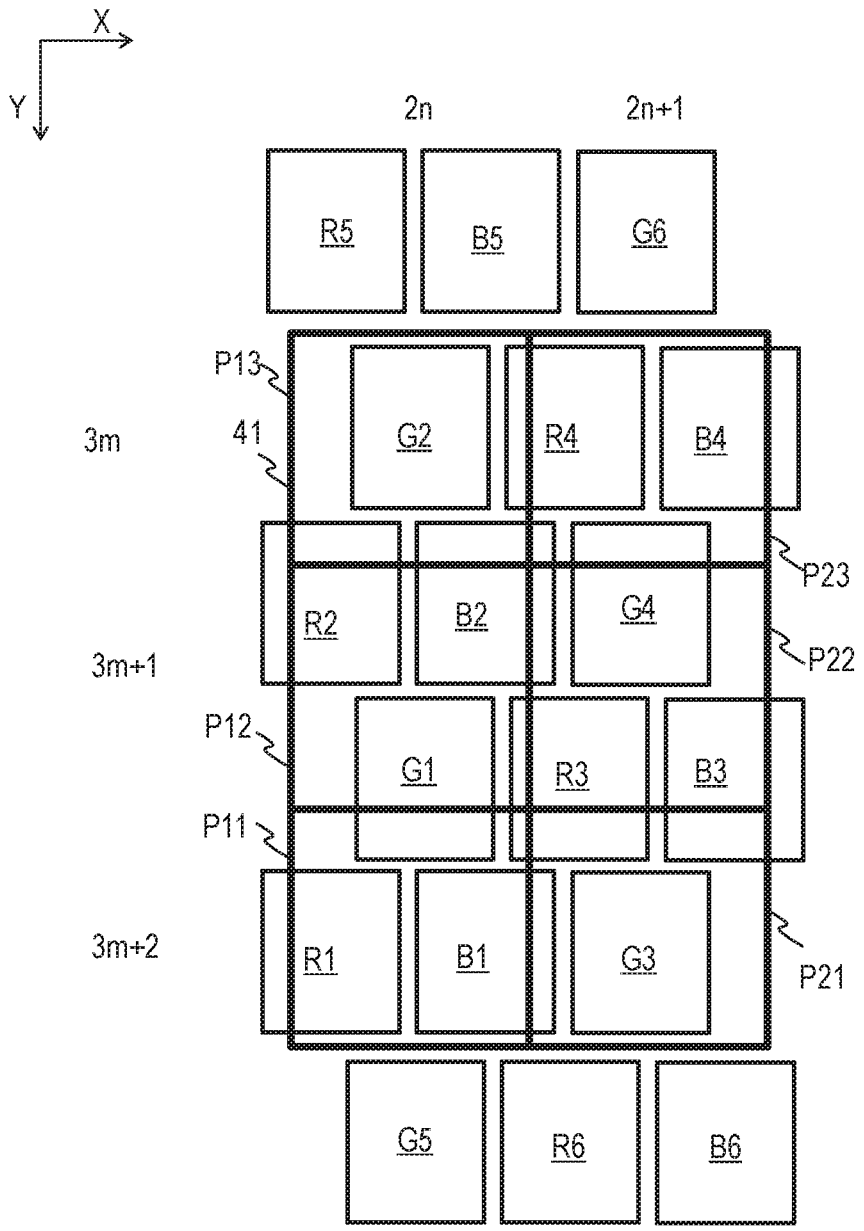
FIG. 9A illustrates a frame unit region and panel subpixels to be assigned the relative luminance values for the frame unit region in Embodiment 2.

FIG. 9A illustrates a frame unit region 41 and the panel subpixels to be assigned relative luminance values for the frame unit region 41. The relative luminance values for the frame unit region 41 are assigned to the corresponding panel unit region 45 and a plurality of subpixels R5, R6, G5, G6, B5, and B6 adjacent to the panel unit region 45 in the column direction.

In assigning the relative luminance values, one pixel column of the frame unit region 41 is associated with one subpixel column in the panel unit region 45. The subpixel column associated with the pixel column consisting of frame pixels P11, P12, and P13 is composed of one subpixel in each odd-numbered subpixel row and two subpixels in each even-numbered subpixel row in the panel unit region 45. Specifically, this subpixel column consists of subpixels R1, B1, G1, R2, B2, and G2.

The subpixel column associated with the pixel column consisting of frame pixels P21, P22, and P23 is composed of two subpixels in each odd-numbered subpixel row and one subpixels in each even-numbered subpixel row in the panel unit region 45. Specifically, this subpixel column consists of subpixels G3, R3, B3, G4, R4, and B4.

As illustrated in FIG. 9A, the relative luminance values for one pixel column in the frame unit region 41 are assigned to one subpixel column in the panel unit region 45 and the subpixels adjacent to the subpixel column in the column direction. Hereinafter, relations between a pixel in a frame unit region 41 and the subpixels to be assigned the relative luminance values for the pixel are described.

Figure 9B:
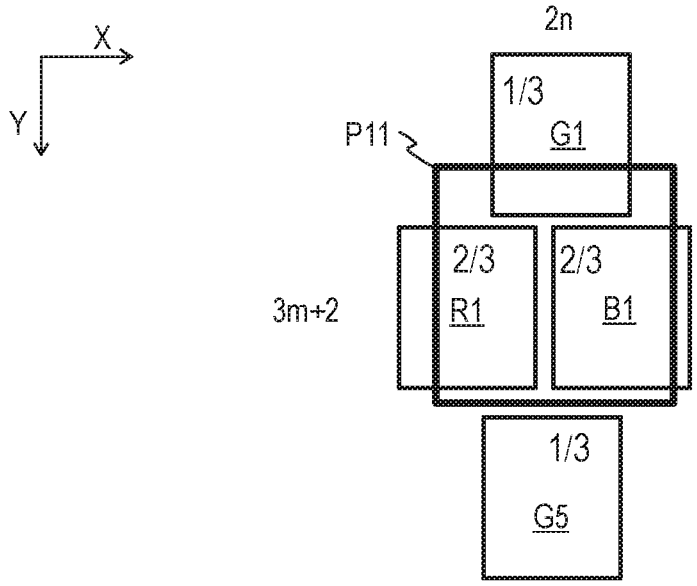
FIG. 9B illustrates a frame pixel and subpixels to be assigned the relative luminance values for the frame pixel in Embodiment 2.

FIG. 9B illustrates the frame pixel P11 and the subpixels to be assigned the relative luminance values for the frame pixel P11. The relative luminance values for the frame pixel P11 are assigned to the subpixels G5, R1, B1, and G1. The relative luminance values to be assigned to the subpixels G5, R1, B1, and G1 are the same as those described with reference to FIG. 5B. The subpixel G5 is a subpixel in a panel unit region adjacent to the panel unit region 45 in the column direction and it is adjacent to the subpixels R1 and B1.

Figure 9C:
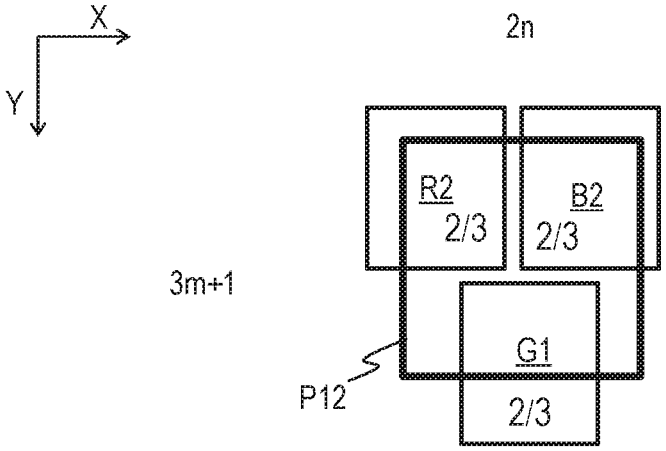
FIG. 9C illustrates a frame pixel and subpixels to be assigned the relative luminance values for the frame pixel in Embodiment 2.

FIG. 9C illustrates the frame pixel P12 and the subpixels to be assigned the relative luminance values for the frame pixel P12. The relative luminance values for the frame pixel P12 are assigned to the subpixels G1, R2, and B2 and the values to be assigned are the same as those described with reference to FIG. 5C.

Figure 9D:
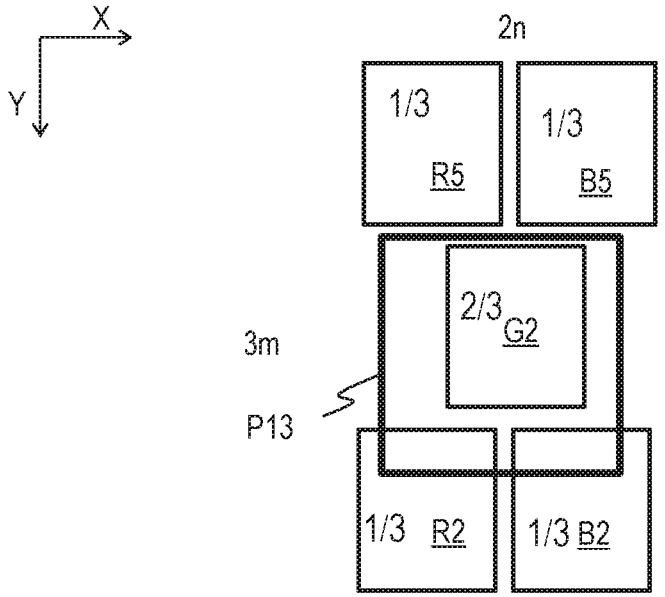
FIG. 9D illustrates a frame pixel and subpixels to be assigned the relative luminance values for the frame pixel in Embodiment 2.

FIG. 9D illustrates the frame pixel P13 and the subpixels to be assigned the relative luminance values for the frame pixel P13. The relative luminance values for the frame pixel P13 are assigned to the subpixels R2, B2, G2, R5, and B5 and the values to be assigned are the same as those described with reference to FIG. 5D. The subpixels R5 and B5 are subpixels in a panel unit region adjacent to the panel unit region 45 in the column direction and they are adjacent to the subpixel G2.

Figure 9E:
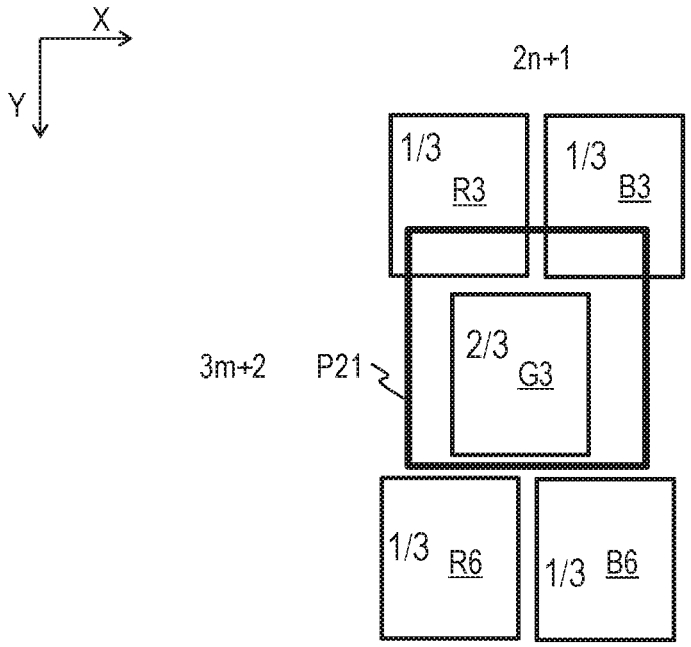
FIG. 9E illustrates a frame pixel and subpixels to be assigned the relative luminance values for the frame pixel in Embodiment 2.

FIG. 9E illustrates the frame pixel P21 and the subpixels to be assigned the relative luminance values for the frame pixel P21. The relative luminance values for the frame pixel P21 are assigned to the subpixels R6, B6, G3, R3, and B3 and the values to be assigned are the same as those described with reference to FIG. 5E. The subpixels R6 and B6 are subpixels in a panel unit region adjacent to the panel unit region 45 in the column direction and they are adjacent to the subpixel G3.

Figure 9F:
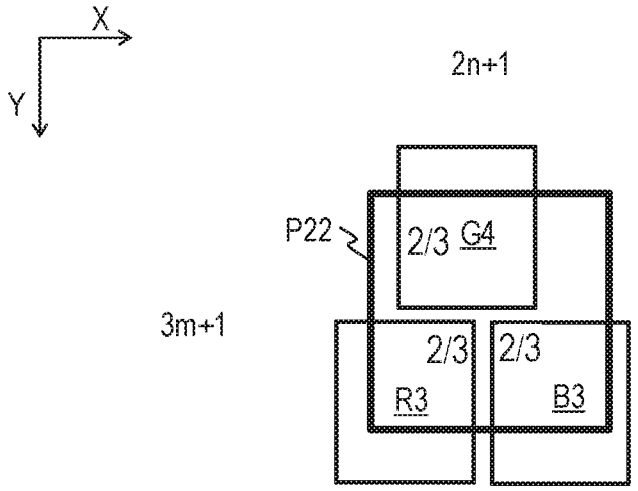
FIG. 9F illustrates a frame pixel and subpixels to be assigned the relative luminance values for the frame pixel in Embodiment 2.

FIG. 9F illustrates the frame pixel P22 and the subpixels to be assigned the relative luminance values for the frame pixel P22. The relative luminance values for the frame pixel P22 are assigned to the subpixels R3, B3, and G4 and the values to be assigned are the same as those described with reference to FIG. 5F.

Figure 9G:
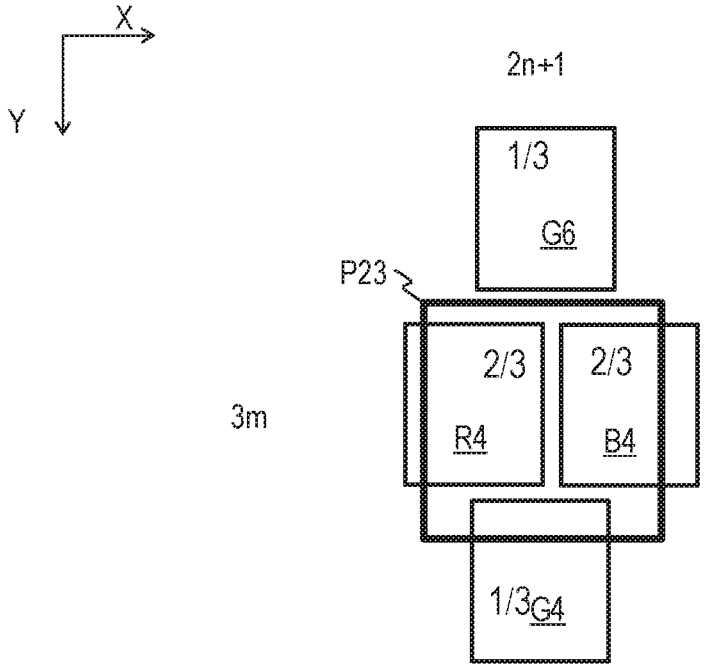
FIG. 9G illustrates a frame pixel and subpixels to be assigned the relative luminance values for the frame pixel in Embodiment 2.

FIG. 9G illustrates the frame pixel P23 and the subpixels to be assigned the relative luminance values for the frame pixel P23. The relative luminance values for the frame pixel P23 are assigned to the subpixels G4, R4, B4, and G6 and the values to be assigned are the same as those described with reference to FIG. 5G. The subpixel G6 is a subpixel in a panel unit region adjacent to the panel unit region 45 in the column direction and it is adjacent to the subpixels R4 and B4.

Figure 10A:
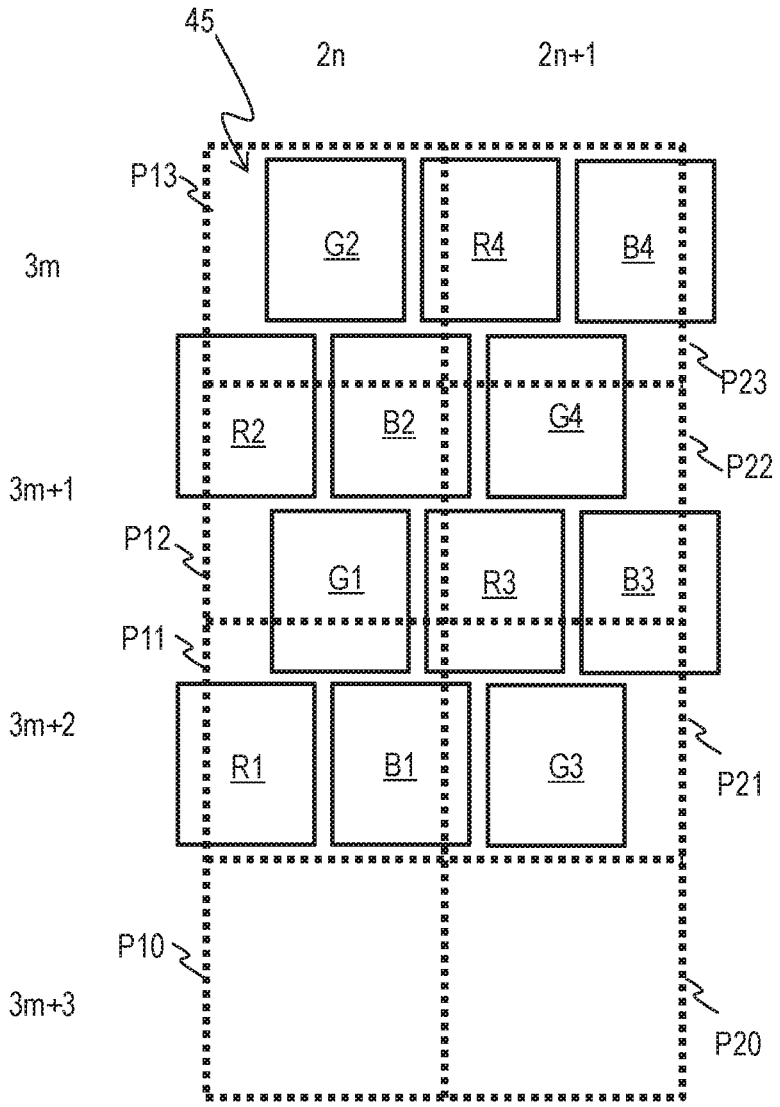
FIG. 10A illustrates a panel unit region and frame pixels from which relative luminance values are assigned to the panel unit region in Embodiment 2.

Next, relative luminance values to be assigned from two frame pixels to subpixel(s) included in a panel unit region 45 are described. FIG. 10A illustrates a panel unit region 45 and the frame pixels from which relative luminance values are assigned to the panel unit region 45. The panel unit region 45 is assigned relative luminance values from the corresponding frame unit region 41 and frame pixels in other frame unit regions adjacent to the frame unit region 41 in the column direction.

Figure 10B:
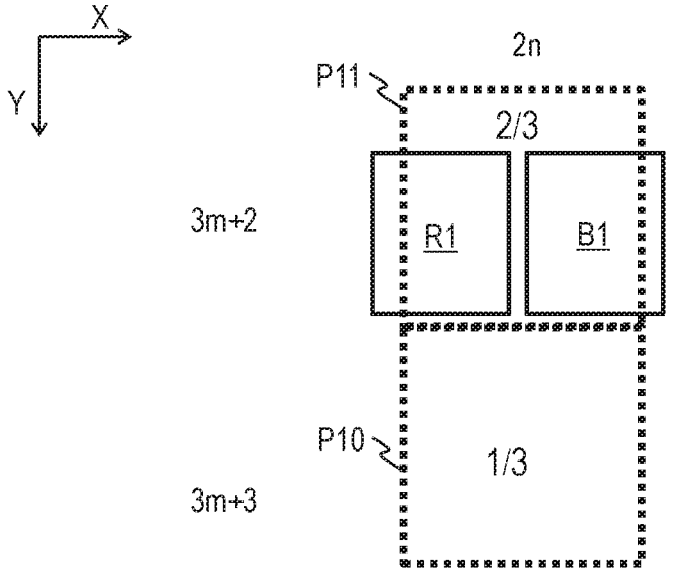
FIG. 10B illustrates subpixels and frame pixels to assign their relative luminance values to the subpixels in Embodiment 2.

FIG. 10B illustrates the subpixels R1 and B1 and the frame pixels to assign their relative luminance values to the subpixels R1 and B1. The subpixel R1 is assigned the relative luminance values for the red of the frame pixel P10 and the frame pixel P11 adjacent to each other in the column direction. The relative luminance values to be assigned are the same as those described with reference to FIG. 6B.

The subpixel B1 is assigned relative luminance values for the blue of the frame pixel P10 and the frame pixel P11 adjacent to each other in the column direction. The relative luminance values to be assigned are the same as those described with reference to FIG. 6B.

Figure 10C:
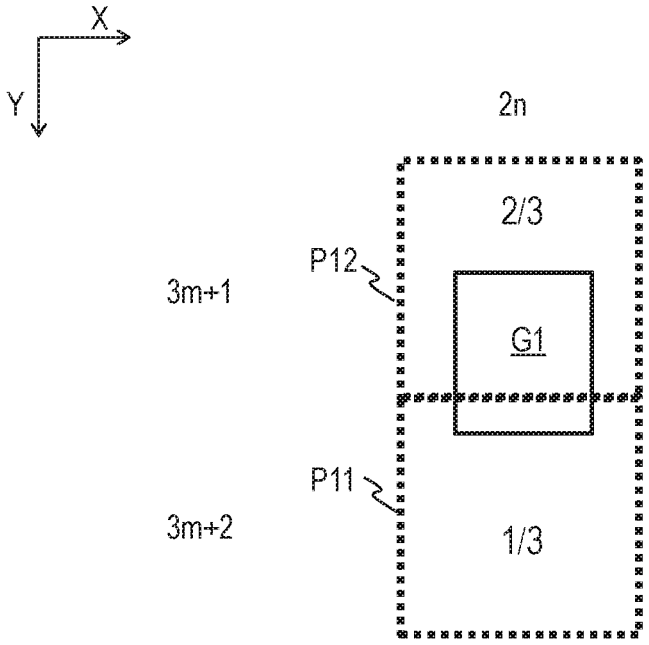
FIG. 10C illustrates a subpixel and frame pixels to assign their relative luminance values to the subpixel in Embodiment 2.

FIG. 10C illustrates a subpixel G1 and the frame pixels to assign their relative luminance values to the subpixel G1. The subpixel G1 is assigned relative luminance values for the green of the frame pixel P11 and the frame pixel P12 adjacent to each other in the column direction. The relative luminance values to be assigned are the same as those described with reference to FIG. 6C.

Figure 10D:
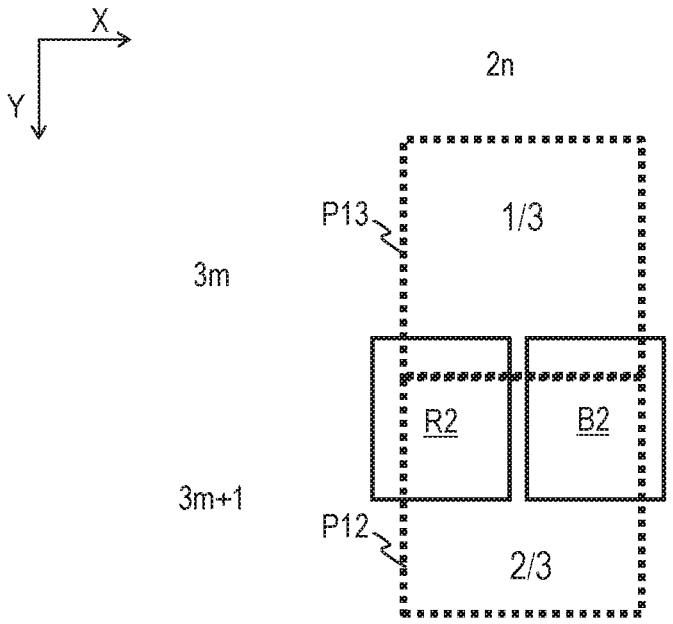
FIG. 10D illustrates subpixels and frame pixels to assign their relative luminance values to the subpixels in Embodiment 2.

FIG. 10D illustrates the subpixels R2 and B2 and the frame pixels to assign their relative luminance values to the subpixels R2 and B2. The subpixel R2 is assigned relative luminance value for the red of the frame pixel P12 and the frame pixel P13 adjacent to each other in the column direction. The relative luminance values to be assigned are the same as those described with reference to FIG. 6D.

The subpixel B2 is assigned the relative luminance values for the blue of the frame pixel P12 and the frame pixel P13 adjacent to each other in the column direction. The relative luminance values to be assigned are the same as those described with reference to FIG. 6D.

Figure 10E:
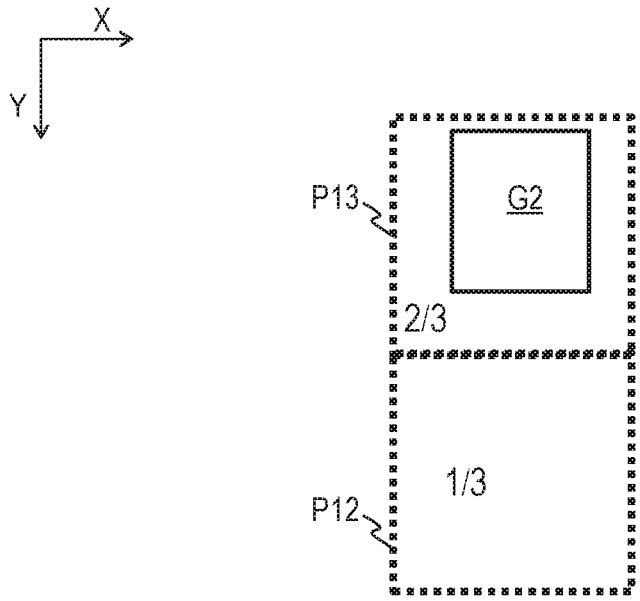
FIG. 10E illustrates a subpixel and frame pixels to assign their relative luminance values to the subpixel in Embodiment 2.

FIG. 10E illustrates the subpixel G2 and the frame pixels to assign their relative luminance values to the subpixel G2. The subpixel G2 is assigned the relative luminance values for the green of the frame pixel P12 and the frame pixel P13 adjacent to each other in the column direction. The relative luminance values to be assigned are the same as those described with reference to FIG. 6E.

Figure 10F:
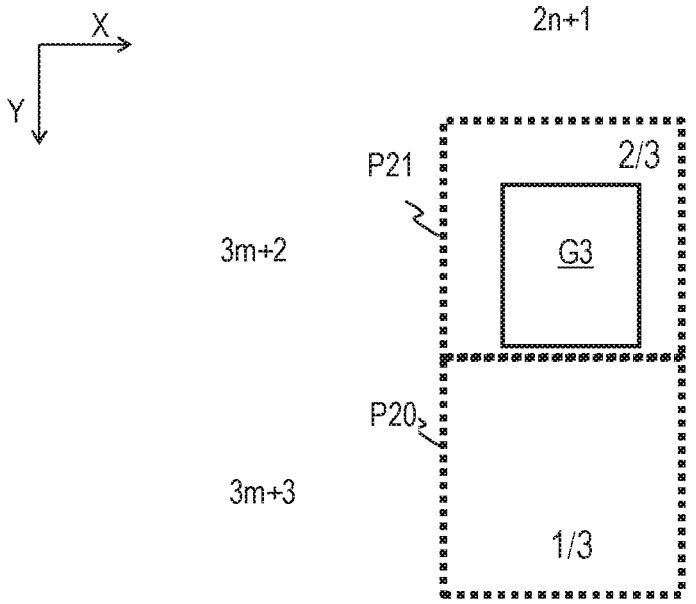
FIG. 10F illustrates a subpixel and frame pixels to assign their relative luminance values to the subpixel in Embodiment 2.

FIG. 10F illustrates the subpixel G3 and the frame pixels to assign their relative luminance values to the subpixel G3. The subpixel G3 is assigned the relative luminance values for the green of the frame pixel P20 and the frame pixel P21 adjacent to each other in the column direction. The relative luminance values to be assigned are the same as those described with reference to FIG. 6F.

Figure 10G:
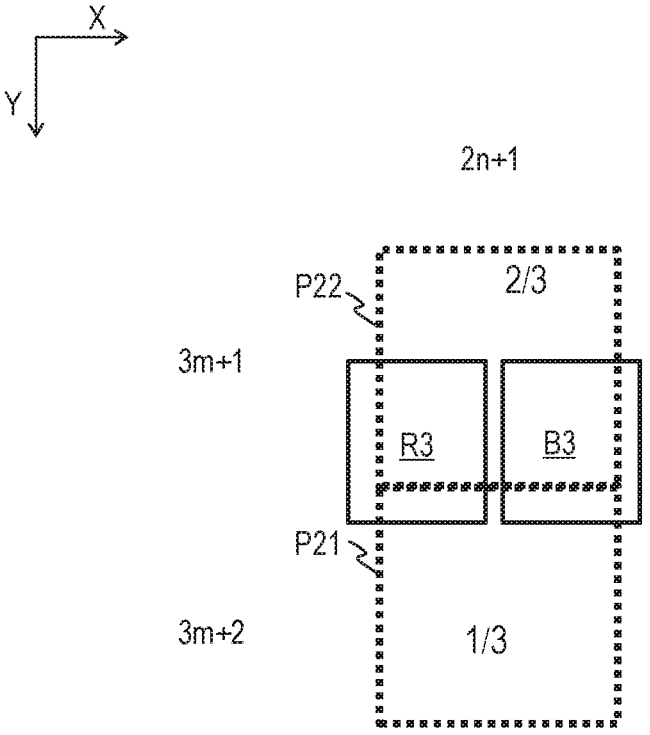
FIG. 10G illustrates subpixels and frame pixels to assign their relative luminance values to the subpixels in Embodiment 2.

FIG. 10G illustrates the subpixels R3 and B3 and the frame pixels to assign their relative luminance values to the subpixels R3 and B3. The subpixel R3 is assigned the relative luminance value for the red of the frame pixel P21 and the frame pixel P22 adjacent to each other in the column direction. The relative luminance values to be assigned are the same as those described with reference to FIG. 6G.

The subpixel B3 is assigned the relative luminance values for the blue of the frame pixel P21 and the frame pixel P22 adjacent to each other in the column direction. The relative luminance values to be assigned are the same as those described with reference to FIG. 6G.

Figure 10H:
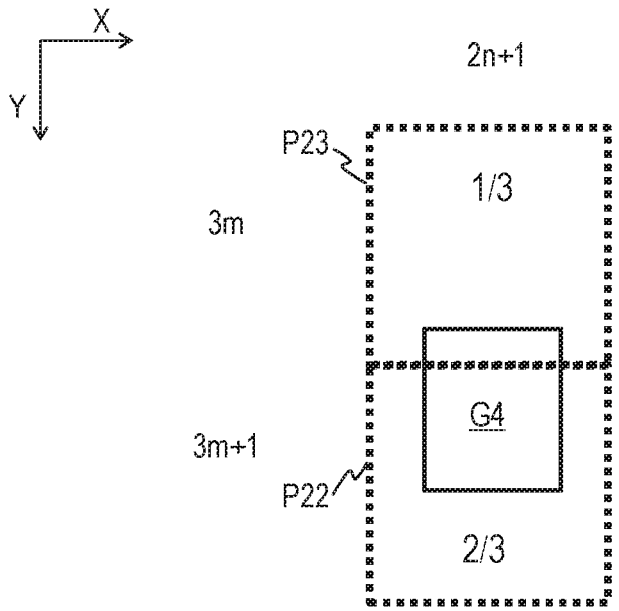
FIG. 10H illustrates a subpixel and frame pixels to assign their relative luminance values to the subpixel in Embodiment 2.

FIG. 10H illustrates the subpixel G4 and the frame pixels to assign their relative luminance values to the subpixel G4. The subpixel G4 is assigned the relative luminance values for the green of the frame pixel P22 and the frame pixel P23 adjacent to each other in the column direction. The relative luminance values to be assigned are the same as those described with reference to FIG. 6G.

Figure 10I:
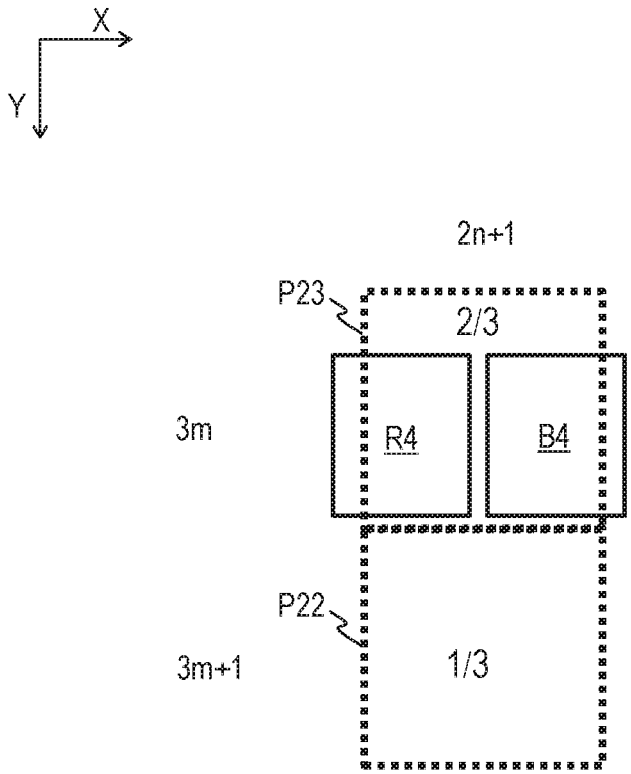
FIG. 10I illustrates subpixels and frame pixels to assign their relative luminance values to the subpixels in Embodiment 2.

FIG. 10I illustrates the subpixels R4 and B4 and the frame pixels to assign their relative luminance values to the subpixels R4 and B4. The subpixel R4 is assigned the relative luminance values for the red of the frame pixel P22 and the frame pixel P23 adjacent to each other in the column direction. The relative luminance values to be assigned are the same as those described with reference to FIG. 6I.

The subpixel B4 is assigned the relative luminance values for the blue of the frame pixel P22 and the frame pixel P23 adjacent to each other in the column direction. The relative luminance values to be assigned are the same as those described with reference to FIG. 6I.

The description about the modifications and effects on the configuration provided with reference to FIGS. 4 to 6I in Embodiment 1 is applicable to the configuration of this embodiment.

Embodiment 3

This embodiment adds dummy frame pixels around a picture frame. This configuration reduces the degradation in display quality in the periphery of the display region 125. Although the dummy frames are essential to neither Embodiment 1 nor Embodiment 2, they are applicable to either embodiment.

Figure 11:
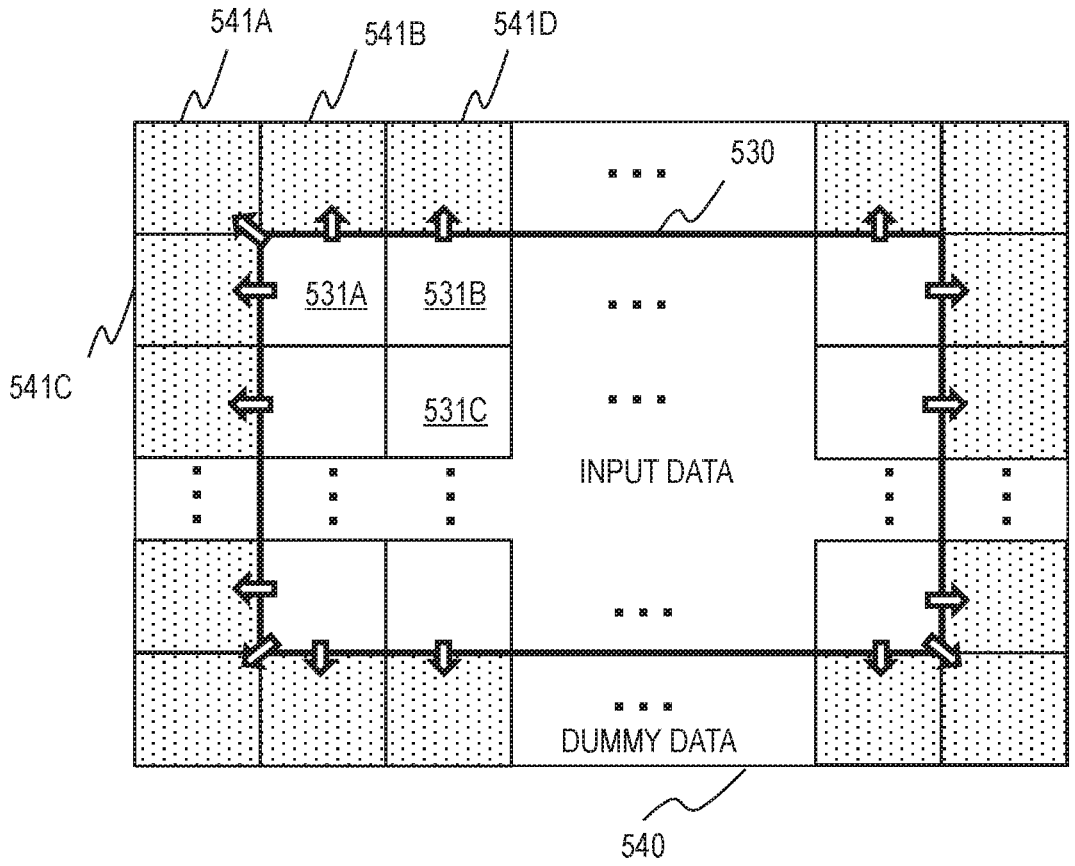
FIG. 11 illustrates a picture frame (input data) and dummy data provided around the picture frame in Embodiment 3.

FIG. 11 illustrates a picture frame (input data) 530 and dummy data 540 provided around the picture frame. The dummy data 540 is data for dummy pixels provided around the picture frame. In FIG. 11, only parts of the frame pixels are indicated with reference signs 531A, 531B, and 531C. Furthermore, only parts of the dummy pixels are indicated with reference signs 541A to 541D.

An example assigns a dummy pixel the same relative luminance values (a tuple of R, G, and B relative luminance values) as those for the adjacent (closest) frame pixel. Taking the example of FIG. 11, the relative luminance values for the dummy pixels 541A, 541B, and 541C are the same as the relative luminance values for the adjacent frame pixel 531A. The relative luminance values for the dummy pixel 541D is the same as the relative luminance values for the adjacent frame pixel 531B. This example assigns the relative luminance values for the outermost frame pixels to the dummy pixels adjacent in the row direction or the column direction and further, assigns the relative luminance values for the frame pixels on a corner to the dummy pixels adjacent in the row direction, column direction, and the diagonal direction.

The relative luminance converter 342 in the driver IC 134 calculates the relative luminance values for the dummy pixels from the relative luminance values for the frame pixels. The relative luminance converter 342 determines the relative luminance value for each panel subpixel from the relative luminance values for a frame pixel and dummy pixel(s). The method of determining the relative luminance values for a dummy pixel depends on the design and is not limited to the above-described relations. For example, the relative luminance values for one dummy pixel can be determined from the product sum of the relative luminance values for one or more frame pixels and the weights assigned thereto.

As set forth above, embodiments of this invention have been described; however, this invention is not limited to the foregoing embodiments. Those skilled in the art can easily modify, add, or convert each element in the foregoing embodiment within the scope of this invention. A part of the configuration of one embodiment can be replaced with a configuration of another embodiment or a configuration of an embodiment can be incorporated into a configuration of another embodiment.

What is claimed is:

1. A method of converting relative luminance data for a picture frame to relative luminance data for a display panel, the picture frame including a region composed of a plurality of frame unit regions disposed in a matrix, each of the plurality of frame unit regions consisting of:

a first pixel, a second pixel, and a third pixel disposed in a first direction in order of the first pixel, the second pixel and the third pixel; and a fourth pixel, a fifth pixel, and a sixth pixel disposed in the first direction to be adjacent to the first pixel, the second pixel, and the third pixel, respectively, in a second direction perpendicular to the first direction, a display region of the display panel including a region composed of a plurality of panel unit regions disposed in a matrix, each of the plurality of panel unit regions including:

a first subpixel line consisting of a first subpixel of a first color, a first subpixel of a second color, and a first subpixel of a third color disposed in the second direction in order of the first subpixel of the first color, the first subpixel of the second color, and the first subpixel of the third color;

a second subpixel line consisting of a second subpixel of the third color, a second subpixel of the first color, and a second subpixel of the second color disposed in the second direction in order of the second subpixel of the third color, the second subpixel of the first color, and the second subpixel of the second color, the second subpixel line being adjacent to the first subpixel line in the first direction;

a third subpixel line consisting of a third subpixel of the first color, a third subpixel of the second color, and a third subpixel of the third color disposed in the second direction in order of the third subpixel of the first color, the third subpixel of the second color, and the third subpixel of the third color, the third subpixel line being adjacent to the second subpixel line in the first direction; and a fourth subpixel line consisting of a fourth subpixel of the third color, a fourth subpixel of the first color, and a fourth subpixel of the second color disposed in the second direction in order of the fourth subpixel of the third color, the fourth subpixel of the first color, and the fourth subpixel of the second color, the fourth subpixel line being adjacent to the third subpixel line in the first direction, a first frame unit region being associated with a first panel unit region, and the method comprising:

determining a relative luminance value for the first subpixel of the first color in the first panel unit region from a relative luminance value for the first color of the first pixel in the first frame unit region and a relative luminance value for the first color of the third pixel in a second frame unit region adjacent to the first pixel on the opposite side from the second pixel in the first frame unit region;

determining a relative luminance value for the first subpixel of the second color in the first panel unit region from a relative luminance value for the second color of the first pixel in the first frame unit region and a relative luminance value for the second color of the third pixel in the second frame unit region;

determining a relative luminance value for the first subpixel of the third color in the first panel unit region from a relative luminance value for the third color of the fourth pixel in the first frame unit region and a relative luminance value for the third color of the sixth pixel in the second frame unit region adjacent to the fourth pixel on the opposite side from the fifth pixel in the first frame unit region;

determining a relative luminance value for the second subpixel of the third color in the first panel unit region from a relative luminance value for the third color of the first pixel in the first frame unit region and a relative luminance value for the third color of the second pixel in the first frame unit region;

determining a relative luminance value for the second subpixel of the first color in the first panel unit region from a relative luminance value for the first color of the fourth pixel in the first frame unit region and a relative luminance value for the first color of the fifth pixel in the first frame unit region;

determining a relative luminance value for the second subpixel of the second color in the first panel unit region from a relative luminance value for the second color of the fourth pixel in the first frame unit region and a relative luminance value for the second color of the fifth pixel in the first frame unit region;

determining a relative luminance value for the third subpixel of the first color in the first panel unit region from a relative luminance value for the first color of the second pixel in the first frame unit region and a relative luminance value for the first color of the third pixel in the first frame unit region;

determining a relative luminance value for the third subpixel of the second color in the first panel unit region from a relative luminance value for the second color of the second pixel in the first frame unit region and a relative luminance value for the second color of the third pixel in the first frame unit region;

determining a relative luminance value for the third subpixel of the third color in the first panel unit region from a relative luminance value for the third color of the fifth pixel in the first frame unit region and a relative luminance value for the third color of the sixth pixel in the first frame unit region;

determining a relative luminance value for the fourth subpixel of the third color in the first panel unit region from a relative luminance value for the third color of the second pixel in the first frame unit region and a relative luminance value for the third color of the third pixel in the first frame unit region;

determining a relative luminance value for the fourth subpixel of the first color in the first panel unit region from a relative luminance value for the first color of the fifth pixel in the first frame unit region and a relative luminance value for the first color of the sixth pixel in the first frame unit region; and determining a relative luminance value for the fourth subpixel of the second color in the first panel unit region from a relative luminance value for the second color of the fifth pixel in the first frame unit region and a relative luminance value for the second color of the sixth pixel in the first frame unit region.

2. The method according to claim 1, wherein the centroids of the subpixels included in the first subpixel line are located on the same points as the centroids of the subpixels included in the third subpixel line in the second direction, wherein the centroids of the subpixels included in the second subpixel line are located on the same points as the centroids of the subpixels included in the fourth subpixel line in the second direction, wherein the centroid of the second subpixel of the third color is located between the centroid of the first subpixel of the first color and the centroid of the first subpixel of the second color in the second direction, wherein the centroid of the second subpixel of the first color is located between the centroid of the first subpixel of the second color and the centroid of the first subpixel of the third color in the second direction, and wherein the centroid of the first subpixel of the third color is located between the centroid of the second subpixel of the first color and the centroid of the second subpixel of the second color in the second direction.

3. The method according to claim 1, wherein a relative luminance value for a subpixel in each panel unit region is a value obtained by summing predetermined rates of relative luminance values for the two pixels associated with the subpixel, and wherein values obtained by summing the predetermined rates for two pixels associated with a subpixel are the same among all subpixels in the panel unit region.

4. The method according to claim 1, wherein a relative luminance value for a subpixel in each panel unit region is a value obtained by summing predetermined rates of relative luminance values for the two pixels associated with the subpixel, and wherein rates for relative luminance values assigned from each pixel in the frame unit region to associated subpixels of the first color, the second color and the third color are the same among the three colors.

5. The method according to claim 4, wherein relative luminance values for a pixel in each frame unit region are assigned to one or two subpixels in each of the three colors, wherein the rate for the relative luminance values to be assigned to one subpixel is ⅔, and wherein the rate for the relative luminance values to be assigned to two subpixels is ⅓ for each subpixel.

6. The method according to claim 1, wherein the first subpixel of the first color, the first subpixel of the second color, the second subpixel of the third color, the third subpixel of the first color, the third subpixel of the second color, and the fourth subpixel of the third color are connected with a first scanning line, and wherein the first subpixel of the third color, the second subpixel of the first color, the second subpixel of the second color, the third subpixel of the third color, the fourth subpixel of the first color, and the fourth subpixel of the second color are connected with a second scanning line different from the first scanning line.

7. The method according to claim 1, wherein the relative luminance data for the display panel is converted from relative luminance data for the pixels of the picture frame and dummy pixels disposed outside of the pixels of the picture frame.

8. The method according to claim 7, wherein relative luminance values for each dummy pixel correspond to relative luminance values for the pixel or pixels closest to the dummy pixel.

9. A display device comprising:

a display panel having a display region including a plurality of subpixels of a first color, a second color, and a third color; and a controller configured to control the display panel, wherein the controller is configured to convert relative luminance data for a picture frame to relative luminance data for the display panel, wherein the picture frame includes a region composed of a plurality of frame unit regions disposed in a matrix, wherein each of the plurality of frame unit regions consists of:

a first pixel, a second pixel, and a third pixel disposed in a first direction in order of the first pixel, the second pixel and the third pixel; and a fourth pixel, a fifth pixel, and a sixth pixel disposed in the first direction to be adjacent to the first pixel, the second pixel, and the third pixel, respectively, in a second direction perpendicular to the first direction, wherein the display region of the display panel includes a region composed of a plurality of panel unit regions disposed in a matrix, wherein each of the plurality of panel unit regions includes:

a first subpixel line consisting of a first subpixel of a first color, a first subpixel of a second color, and a first subpixel of a third color disposed in the second direction in order of the first subpixel of the first color, the first subpixel of the second color, and the first subpixel of the third color;

a second subpixel line consisting of a second subpixel of the third color, a second subpixel of the first color, and a second subpixel of the second color disposed in the second direction in order of the second subpixel of the third color, the second subpixel of the first color, and the second subpixel of the second color, the second subpixel line being adjacent to the first subpixel line in the first direction;

a third subpixel line consisting of a third subpixel of the first color, a third subpixel of the second color, and a third subpixel of the third color disposed in the second direction in order of the third subpixel of the first color, the third subpixel of the second color, and the third subpixel of the third color, the third subpixel line being adjacent to the second subpixel line in the first direction; and a fourth subpixel line consisting of a fourth subpixel of the third color, a fourth subpixel of the first color, and a fourth subpixel of the second color disposed in the second direction in order of the fourth subpixel of the third color, the fourth subpixel of the first color, and the fourth subpixel of the second color, the fourth subpixel line being adjacent to the third subpixel line in the first direction, wherein a first frame unit region is associated with a first panel unit region, and wherein the controller is configured to:

determine a relative luminance value for the first subpixel of the first color in the first panel unit region from a relative luminance value for the first color of the first pixel in the first frame unit region and a relative luminance value for the first color of the third pixel in a second frame unit region adjacent to the first pixel on the opposite side from the second pixel in the first frame unit region;

determine a relative luminance value for the first subpixel of the second color in the first panel unit region from a relative luminance value for the second color of the first pixel in the first frame unit region and a relative luminance value for the second color of the third pixel in the second frame unit region;

determine a relative luminance value for the first subpixel of the third color in the first panel unit region from a relative luminance value for the third color of the fourth pixel in the first frame unit region and a relative luminance value for the third color of the sixth pixel in the second frame unit region adjacent to the fourth pixel on the opposite side from the fifth pixel in the first frame unit region;

determine a relative luminance value for the second subpixel of the third color in the first panel unit region from a relative luminance value for the third color of the first pixel in the first frame unit region and a relative luminance value for the third color of the second pixel in the first frame unit region;

determine a relative luminance value for the second subpixel of the first color in the first panel unit region from a relative luminance value for the first color of the fourth pixel in the first frame unit region and a relative luminance value for the first color of the fifth pixel in the first frame unit region;

determine a relative luminance value for the second subpixel of the second color in the first panel unit region from a relative luminance value for the second color of the fourth pixel in the first frame unit region and a relative luminance value for the second color of the fifth pixel in the first frame unit region;

determine a relative luminance value for the third subpixel of the first color in the first panel unit region from a relative luminance value for the first color of the second pixel in the first frame unit region and a relative luminance value for the first color of the third pixel in the first frame unit region;

determine a relative luminance value for the third subpixel of the second color in the first panel unit region from a relative luminance value for the second color of the second pixel in the first frame unit region and a relative luminance value for the second color of the third pixel in the first frame unit region;

determine a relative luminance value for the third subpixel of the third color in the first panel unit region from a relative luminance value for the third color of the fifth pixel in the first frame unit region and a relative luminance value for the third color of the sixth pixel in the first frame unit region;

determine a relative luminance value for the fourth subpixel of the third color in the first panel unit region from a relative luminance value for the third color of the second pixel in the first frame unit region and a relative luminance value for the third color of the third pixel in the first frame unit region;

determine a relative luminance value for the fourth subpixel of the first color in the first panel unit region from a relative luminance value for the first color of the fifth pixel in the first frame unit region and a relative luminance value for the first color of the sixth pixel in the first frame unit region; and determine a relative luminance value for the fourth subpixel of the second color in the first panel unit region from a relative luminance value for the second color of the fifth pixel in the first frame unit region and a relative luminance value for the second color of the sixth pixel in the first frame unit region.

10. The display device according to claim 9, wherein the centroids of the subpixels included in the first subpixel line are located on the same points as the centroids of the subpixels included in the third subpixel line in the second direction, wherein the centroids of the subpixels included in the second subpixel line are located on the same points as the centroids of the subpixels included in the fourth subpixel line in the second direction, wherein the centroid of the second subpixel of the third color is located between the centroid of the first subpixel of the first color and the centroid of the first subpixel of the second color in the second direction, wherein the centroid of the second subpixel of the first color is located between the centroid of the first subpixel of the second color and the centroid of the first subpixel of the third color in the second direction, and wherein the centroid of the first subpixel of the third color is located between the centroid of the second subpixel of the first color and the centroid of the second subpixel of the second color in the second direction.

11. The display device according to claim 9, wherein a relative luminance value for a subpixel in each panel unit region is a value obtained by summing predetermined rates of relative luminance values for the two pixels associated with the subpixel, and wherein values obtained by summing the predetermined rates for two pixels associated with a subpixel are the same among all subpixels in the panel unit region.

12. The display device according to claim 9, wherein a relative luminance value for a subpixel in each panel unit region is a value obtained by summing predetermined rates of relative luminance values for the two pixels associated with the subpixel, and wherein rates for relative luminance values assigned from each pixel in the frame unit region to associated subpixels of the first color, the second color and the third color are the same among the three colors.

13. The display device according to claim 12, wherein relative luminance values for a pixel in each frame unit region are assigned to one or two subpixels in each of the three colors, wherein the rate for the relative luminance values to be assigned to one subpixel is ⅔, and wherein the rate for the relative luminance values to be assigned to two subpixels is ⅓ for each subpixel.

14. The display device according to claim 9, wherein the first subpixel of the first color, the first subpixel of the second color, the second subpixel of the third color, the third subpixel of the first color, the third subpixel of the second color, and the fourth subpixel of the third color are connected with a first scanning line, and wherein the first subpixel of the third color, the second subpixel of the first color, the second subpixel of the second color, the third subpixel of the third color, the fourth subpixel of the first color, and the fourth subpixel of the second color are connected with a second scanning line different from the first scanning line.

15. The display device according to claim 9, wherein the relative luminance data for the display panel is converted from relative luminance data for the pixels of the picture frame and dummy pixels disposed outside of the pixels of the picture frame.

16. The display device according to claim 15, wherein relative luminance values for each dummy pixel correspond to relative luminance values for the pixel or pixels closest to the dummy pixel.

* * * * *